US010856093B2

(12) United States Patent
Buchner et al.

(10) Patent No.: US 10,856,093 B2
(45) Date of Patent: Dec. 1, 2020

(54) SYSTEM AND METHOD FOR HANDLING DIGITAL CONTENT

(71) Applicant: Holosbase GmbH, Berlin (DE)

(72) Inventors: Herbert Buchner, Nittendorf (DE); Hakim Ziad, Berlin (DE)

(73) Assignee: HOLOSBASE GMBH, Berlin (DE)

( * ) Notice: Subject to any disclaimer, the term of this patent is extended or adjusted under 35 U.S.C. 154(b) by 0 days.

(21) Appl. No.: 16/386,507

(22) Filed: Apr. 17, 2019

(65) Prior Publication Data

US 2019/0253821 A1 Aug. 15, 2019

Related U.S. Application Data

(63) Continuation of application No. PCT/EP2017/076487, filed on Oct. 17, 2017.

(30) Foreign Application Priority Data

Oct. 19, 2016 (EP) ..... 16194645

(51) Int. Cl.
*H04S 3/00* (2006.01)
*H04R 3/00* (2006.01)
(Continued)

(52) U.S. Cl.
CPC ..... *H04S 3/008* (2013.01); *H04R 3/005* (2013.01); *H04R 3/02* (2013.01); *H04R 3/12* (2013.01);
(Continued)

(58) Field of Classification Search
CPC . H04S 3/008; H04S 7/30; H04S 7/301; H04S 7/302; H04S 2400/01;
(Continued)

(56) References Cited

U.S. PATENT DOCUMENTS 7,711,443 B1 5/2010 Sanders et al.
2004/0131192 A1 7/2004 Metcalf
(Continued)

FOREIGN PATENT DOCUMENTS

EP 1306993 A2 5/2003

OTHER PUBLICATIONS

CTG, 2014, Expand Your IP Teleconferencing to Full Room Audio.*
(Continued)

*Primary Examiner* — William A Jerez Lora
(74) *Attorney, Agent, or Firm* — McClure, Qualey & Rodack, LLP

(57) ABSTRACT

The invention refers to a system for handling digital content including an input interface, a calculator, and an output interface. The input interface receives digital content and includes a plurality of input channels. At least one input channel receives digital content from a sensor or a group of sensors belonging to a recording session. The calculator provides output digital content by adapting received digital content to a reproduction session in which the output digital content is to be reproduced. The output interface outputs the output digital content and includes a plurality of output channels, wherein at least one output channel outputs the output digital content to an actuator or a group of actuators belonging to the reproduction session. Further, the input interface, the calculator, and the output interface are connected with each other via a network. The input interface is configured to receive digital content via by Ni input channels, where the number Ni is based on a user interaction, and/or the output interface is configured to output the output digital content via by No output channels, where the number No is based on a user interaction. The invention further refers to a corresponding method.

19 Claims, 9 Drawing Sheets

(51) Int. Cl.

| | |
|---|---|
| ***H04R 3/02*** | (2006.01) |
| ***H04S 7/00*** | (2006.01) |
| ***H04R 3/12*** | (2006.01) |
| ***H04R 5/04*** | (2006.01) |

(52) U.S. Cl.
CPC ..... *H04R 5/04* (2013.01); *H04S 7/30* (2013.01); *H04S 7/301* (2013.01); *H04S 7/302* (2013.01); *H04S 2400/01* (2013.01); *H04S 2400/15* (2013.01); *H04S 2420/13* (2013.01)

(58) Field of Classification Search
CPC . H04S 2400/15; H04S 2420/13; H04R 3/005; H04R 3/02; H04R 3/12; H04R 5/04
USPC ..... 381/1, 300
See application file for complete search history.

(56) References Cited

U.S. PATENT DOCUMENTS

| | | | | |
|---|---|---|---|---|
| 2005/0238177 | A1 | 10/2005 | Bruno et al. | |
| 2006/0239465 | A1 | 10/2006 | Montoya et al. | |
| 2009/0204843 | A1 | 8/2009 | Celinski et al. | |
| 2010/0223552 | A1* | 9/2010 | Metcalf ..... | H04S 3/008 715/716 |
| 2013/0129101 | A1 | 5/2013 | Tashev et al. | |
| 2015/0092960 | A1* | 4/2015 | Furumoto ..... | H04B 1/207 381/119 |
| 2016/0182855 | A1* | 6/2016 | Caligor ..... | G11B 27/19 348/14.06 |
| 2016/0227340 | A1 | 8/2016 | Peters | |

OTHER PUBLICATIONS

Candes, E.J., et al.; "Matrix completion with noise;" Proceedings of the IEEE; pp. 1-11.

Fink, M.; "Time reversal of ultrasonic fields—Part I: Basic principles;" IEEE Transactions on Ultrasocics, Ferroelectrics, and Frequency Control; vol. 39; No. 5; Sep. 1992; pp. 555-566.

Helwani, K., et al.; "Multichannel Adaptive Filtering in Compressive Domains;" Proc. IEEE IWAENC; 2014; pp. 1-5.

Helwani, K., et al.; "Multichannel acoustic echo suppression;" Proc. IEEE Int. Conf. on Acoustics, Speech, and Signal Processing (ICASSP); May 2013; pp. 1-5.

Helwani, K., et al.; "The synthesis of sound figures;" Journal on Multidimensional Systems and Signal Processing (MDSSP); Nov. 2013; pp. 1-27.

Hyvarinen, A., et al.; "Independent Component Analysis;" 2001; pp. 1-17.

O'Rouke, J.; "Computational Geometry in C;" 1993; pp. 1-359.

Spors, S., et al.; "The theory of wave field synthesis revisited;" 124th AES Convention; May 2008; pp. 1-19.

Stewart, R., et al.; "Statistical Measures of Early Reflections of Room Impulse Responses;" Proc. of the 10th Int. Conference on Digital Audio Effects (DAFx-07); Sep. 2007; pp. 1-4.

Spors, S.; "Extension of an Analytic Secondary Source Selection Criterion for Wave Field Synthesis;" AES Convention Paper; Oct. 2007; pp. 1-15.

International Search Report and Written Opinion dated Feb. 12, 2018 for PCT/EP2017/076487.

Jang et al. "An Object-based 3D Audio Broadcasting System for Interactive Services" AES Convention 118; May 2005, AES, 60 East 42nd Street, Room 2520 New York 10165-2520, USA, May 1, 2005.

Zotter Franz et al.: All-Round Ambisonic Panning and Decoding JAES, AES, 60 East 42nd Street, Room 2520 New York 10165-2520, USA, vol. 60, No. 10, Oct. 1, 2012 (Oct. 1, 2012), pp. 807-820, XP040574863.

European Office Action dated Oct. 20, 2020, issued in application No. 17783880.2.

* cited by examiner

SYSTEM AND METHOD FOR HANDLING DIGITAL CONTENT

CROSS-REFERENCE TO RELATED APPLICATIONS

This application is a continuation of copending International Application No. PCT/EP2017/076487, filed Oct. 17, 2017, which is incorporated herein by reference in its entirety, and additionally claims priority from European Application No. 16194645.4, filed Oct. 19, 2016, which is also incorporated herein by reference in its entirety.

The invention refers to a system for handling digital content. The invention also refers to a corresponding method and a computer program.

BACKGROUND OF THE INVENTION

Nowadays, devices like, for example, smartphones ease recording audio signals and images. Further, they allow to consume digital data at almost any chosen location. Hence, handling audio signal has become a commodity.

On the other hand, increasing efforts are made in order to improve reproduction or replay of audio data by suitable processing. For this, the audio signals to be reproduced are optimized for the hearing experience of a user. By wave field synthesis (WFS), for example, virtual acoustic environments are created. This is done by generating wave fronts by individually driven loudspeakers based on the Huygens-Fresnel principle and the Kirchhoff-Helmholtz integral. A favorable technique for controlling the spatial distribution of sound level within a synthesized sound field produces sound figures. These sound figures comprise regions with high acoustic level, called bright regions, and zones with low acoustic level, called zones of quiet, see [Helwani].

Missing in the state of art is a convenient and easy way to apply modern audio data processing techniques to the various possibilities of recording and replaying audio data.

SUMMARY

According to an embodiment, a system for handling digital content may have: an input interface, a calculator, and an output interface, wherein the input interface is configured to receive digital content, wherein the input interface includes a plurality of input channels, wherein at least one input channel is configured to receive digital content from a sensor or a group of sensors belonging to a recording session, wherein the calculator is configured to provide output digital content by adapting received digital content to a reproduction session in which the output digital content is to be reproduced, wherein the output interface is configured to output the output digital content, wherein the output interface includes a plurality of output channels, wherein at least one output channel is configured to output the output digital content to an actuator or a group of actuators belonging to the reproduction session, wherein the input interface, the calculator, and the output interface are connected with each other via a network, wherein the input interface is configured to receive digital content by Ni input channels, where the number Ni is based on a user interaction, and/or wherein the output interface is configured to output the output digital content by No output channels, where the number No is based on a user interaction.

According to another embodiment, a method for handling digital content may have the steps of: receiving digital content by a input interface, wherein the input interface includes a plurality of input channels, wherein at least one input channel is configured to receive digital content from a sensor belonging to a recording session, providing output digital content by adapting the received digital content to a reproduction session in which the output digital content is to be reproduced, outputting the output digital content by an output interface, wherein the output interface includes a plurality of output channels, wherein at least one output channel is configured to output the output digital content to an actuator belonging to the reproduction session, wherein the digital content and/or the output digital content is transferred via a network, and wherein the digital content is received by Ni input channels, where the number Ni is based on a user interaction, and/or wherein the output digital content is output by No output channels, where the number No is based on a user interaction.

Another embodiment may have a non-transitory digital storage medium having a computer program stored thereon to perform the method for handling digital content, the method having the steps of: receiving digital content by a input interface, wherein the input interface includes a plurality of input channels, wherein at least one input channel is configured to receive digital content from a sensor belonging to a recording session, providing output digital content by adapting the received digital content to a reproduction session in which the output digital content is to be reproduced, outputting the output digital content by an output interface, wherein the output interface includes a plurality of output channels, wherein at least one output channel is configured to output the output digital content to an actuator belonging to the reproduction session, wherein the digital content and/or the output digital content is transferred via a network, and wherein the digital content is received by Ni input channels, where the number Ni is based on a user interaction, and/or wherein the output digital content is output by No output channels, where the number No is based on a user interaction, when said computer program is run by a computer.

The system or platform allows to combine different recording sessions and different kinds of (input) digital content with different reproduction scenarios. Further, in some embodiments not only the devices for recording (sensors, e.g. microphones) and devices for reproduction (actuator, e.g. loudspeakers) are positioned at different locations, but also the devices for performing an adaption of the digital content from the recording session to the reproduction session are distributed in space. The platform enables to personalize a recording and/or reproduction session concerning e.g. the numbers and positions of the used sensors and actuators respectively.

The invention, thus, in different embodiments allows to upload, share or even to sell digital content (in an embodiment especially audio content). In one embodiment, communication in realtime and in full duplex becomes possible.

The object is achieved by a system for handling digital content. The system comprises an input interface, a calculator, and an output interface. In some of the following embodiments, the input and output interface and/or the calculator, each, can comprise different sub-components or sub-elements that are located at different positions.

The input interface is configured to receive digital content. Further, the input interface comprises a plurality of input channels. At least one input channel is configured to receive digital content from a sensor or a group of sensors belonging to a recording session. In an embodiment, the number of available input channels is at least equal to three.

The calculator is configured to provide output digital content by adapting received digital content to a reproduction session in which the output digital content is to be reproduced. The digital content (which can also be called input digital content) is received by the input interface and is processed by the calculator. The processing of the calculator refers to adapting the digital content to the scenario or reproduction (replay) session in which the digital content is to be reproduced. With other words: the digital content is transformed into output digital content fitting to the reproduction session. The calculator, thus, enables to customize and/or to optimize user sound experience. In one embodiment, the digital content is adapted to the reproduction session by generating sound figures (see [Helwani]).

The output interface is configured to output the output digital content. The output interface comprises a plurality of output channels, wherein at least one output channel is configured to output the output digital content to an actuator or a group of actuators belonging to the reproduction session. The output interface serves for outputting the data provided by the calculator and based on the digital content. The output interface—comparable to the input interface—comprises at least one output channel for the output. In an embodiment, the output interface comprises at least three output channels. In one embodiment, at least one output channel is configured as an audio output channel for transmitting audio signals. Both interfaces allow in an embodiment connections for submitting and/or receiving data or content via the internet or via a local network.

Further, the input interface, the calculator, and the output interface are connected with each other via a network. This implies that in one embodiment the input interface and the calculator and/or the output interface and the calculator are connected via the network.

Hence, it is not needed that all elements of the system are in close proximity as the data are transferred via the network.

The network refers to any kind of carrier or transmitter for digital data. In one embodiment, the network is realized as a part of the internet and/or configured for transmitting data to or from a cloud. In a different embodiment, the network is an electric or electro-optic or electro-magnetic connection between the input interface, calculator, and output interface. In an embodiment, the network comprises any kind of conductor path. In an embodiment, the network allows to connect the input interface and/or the output interface with the internet or with a local network (e.g. a wireless local area network, WLAN). In an embodiment, the network, the input interface, the output interface, and the calculator are realized as a server.

The input interface is configured to receive digital content via Ni input channels, wherein the number Ni is based on a user interaction. Here, the system offers a flexibility concerning the number of input channels to be used by a user for recording digital content. The number of input channels refers in one embodiment to the number of sensors used in a recording session for recording audio signals.

Additionally or alternatively, the output interface is configured to output the output digital content via No output channels, wherein the number No is based on a user interaction.

Here, the number of output channels to be used for the output of the data provided by the calculator in form of the output digital content is set and chosen by the user. In one embodiment, each output channel refers to one actuator in the reproduction session. Hence, the user is not limited in the number of reproduction devices to be used in a reproduction scenario.

Setting the number Ni of input channels and/or the number No of output channels allows the respective user to personalize the recording and/or reproduction to the respectively given situation, e.g. to the number of sensors and/or actuators. In a further embodiment, the personalization is increased by adapting the processing of the digital content and/or output digital content to the actually given positions of the respective nodes (sensors and/or actuators). This is in one embodiment especially done ad hoc, allowing, for example, movements of the nodes during a recording or reproduction session. Thus, in at least one embodiment no previous knowledge about the locations of the nodes is needed as the processing is adapted to the current positions. Hence, there is an ad hoc adaptation.

A network—between the interfaces and the calculator or to be used for connecting to the interfaces—is in one embodiment provided by the internet. This implies that the user uploads digital content via the internet and that a user receives output digital content via the internet. Using a network allows in one embodiment to use devices or components as parts of the calculator. In this last mentioned embodiment, the calculator is split into different subunits that are located at different positions (e.g. recording or reproduction side) and/or associated with different devices.

The system in one embodiment is referred to as platform for ad hoc multichannel audio capturing and rendering. In an embodiment, a server is connected with devices (e.g. sensors or microphones) of the recording session and with devices (e.g. actuators or loudspeakers) of the reproduction session. The mentioned devices are also named nodes. In an embodiment, the system comprises such a server providing the functionality for receiving the digital content and generating the output digital content. In another embodiment, devices of the recording session are connected with devices of the reproduction session by using a suitable application software (i.e. an app). Thus, a kind of App-to-App communication is used between the recording session and the reproduction session. In an embodiment, the devices in both sessions are smartphones. For such an App-to-App-Communication, the calculator is split into different subunits that are associated with the devices (e.g. smartphones) of the recording and reproduction session, respectively. Hence, there is no central unit or server for processing the digital content or providing the output digital content.

In one embodiment, the system as multichannel communication platform comprises a computer or a mobile phone or multiple electronic devices.

In an embodiment, the number of channels for receiving digital data or for outputting output digital content is limited by the bandwidth of the network. Therefore, in an embodiment in which the bandwidth is not supporting all channels, a selection of channels is made by optimizing the spatial coverage and/or the resolution. For example, the maximum number of sensors with the maximum distance to each other are selected.

In an embodiment, the input interface is configured to receive information about the sensor or the sensors if more than one sensor (as a node of the recording session) is used. The information about the sensor refers to a location of the sensor and/or to a location of a content source relative to the sensor. Further, the calculator is configured in an embodiment to provide the output digital content based on the information about the sensor. In order to process the digital content, this embodiment takes the locations of the sensors into consideration. The location refers e.g. to the absolute positions, to the relative positions of different sensors and/or to the location of a sensor relative to a sound source. Based on this location data, the digital content is processed by the calculator. In one embodiment, at least one sensor processes digital data based on the information about its own location.

In one embodiment, the calculator also uses information about the recording characteristics of the sensor (or the sensors) for processing the digital content obtained from the sensor (or sensors). The information about at least one sensor is considered for handling the digital content and for converting the digital content to the output digital content.

In an embodiment, the input interface is configured to receive information about the actuator. The information about the actuator refers to a location of the actuator (as a node of a reproduction session) and/or to a location of a consuming user relative to the actuator. Further, the calculator is configured to provide the output digital content based on the information about the actuator. In this embodiment, the location of the actuators is used for adapting the digital content to the reproduction session and to the requirements of the reproduction scenario.

In an embodiment, the calculator uses information about the reproduction characteristics of the actuator or the actuators for providing the output digital content. In this embodiment, details about how an actuator reproduces signals is considered while adapting the digital content to the reproduction session.

According to an embodiment, the system is configured to provide an internal meta representation layer for digital content. In an embodiment, the internal meta representation layer refers to four different types of channels:

There are capturing or physical channels referring to the sensors or microphones. Optionally, for each sensor/microphone, a directivity measurement is available as single input-/-multiple output system indicating the response of the sensor/microphone in each direction for a given measurement resolution.

There are virtual channels. These are obtained after filtering the individual microphone signals with a multiple input-/-single output system (MISO). The virtual microphones have a type which is determined by the equalization objective. So, in one embodiment, it is a plane wave in the direction of the normal vector augmented with zeros in the direction of the other selected or relevant microphones. In a different embodiment, it is a Higher order Ambisonics (HoA) channel. A scene channel is then assigned to a channel (virtual or physical) and to a model type, e.g. point source. In HoA, the scene has for each source item the model HoA order 1, 2, 3 etc. The filters in the scene map the sources to an array, the array determined by the locations of the reproduction section assuming free field propagation. In a different embodiment, these are virtual loudspeakers whose locations are fixed in a separate metadata.

There are reproduction channels which determine the loudspeaker array parameters, positons, and equalization filters.

Finally, there are scene channels which contain the remixing parameters. The filters in the scene channels map the sources to an array, advantageously the array determined by the locations of the reproduction session assuming free field propagation.

In an embodiment, each channel comprises four files: One for (recorded, modified or output) audio data, one for a location positon (e.g. of the microphone or the loudspeaker), one for a time stamp in case the audio files are not provided with a time stamp, and one comprising filters. Hence, there are in one embodiment (possibly encoded or processed) audio signals and metadata with information.

In an embodiment, the following steps are performed:

An audio source is captured with 32 microphones as sensors in a sphere and the relevant information is stored in the capturing channels. The information from the capturing channels is used to calculate the virtual channels which are needed to calculate the scene channels. Assuming a typical user has got eight speakers, the audio content (or digital content) is rendered by the calculator—in one embodiment by the server—down to eight rendering channels with speakers for a uniform distribution of loudspeakers on a circle. Finally, the user downloads or streams the content to the eight speakers. For the case that the loudspeakers are not uniformly distributed, the rendering equalization filters are deployed to modify the scene channels and to map them optimally to the user's reproduction setup.

In an embodiment, the digital content and/or the output digital content refer/refers to audio data, video data, haptic data, olfactory data, ultrasound data or solid-borne sound data. According to this embodiment, the digital content is not limited to audio data but can belong to a wide range of data. In one embodiment, the digital content and/or the output digital content refer to stereo video signals and/or to holographic data. In an embodiment, the input channels and/or output channels are accordingly configured for transmitting the digital content and output digital content, accordingly. This implies that for transmitting audio data, the input channels and/or output channels are configured as audio input and/or audio output channels, respectively, and for transmitting video data, they are video input channels and video output channels.

According to an embodiment, the calculator is configured to provide modified content by adapting digital content to the reproduction session. In this embodiment, the digital content is adapted to the characteristics of the reproduction session.

In one embodiment, the modified content is the output digital content. In an alternative embodiment, the modified content is further processed in order to get the output digital content to be reproduced by actuators in a reproduction session.

The calculator is configured in one embodiment to provide modified content by adapting digital content to a reproduction session neutral format. In an alternative or additional embodiment, the calculator is configured to adapt the digital content to a recording session neutral format. In these two embodiments, modified content is provided which is neutral with regard to the recording or the reproduction characteristics. Hence, general data is provided that can be used in different scenarios. Neutral refers in this context to an abstract description with e.g. an omnidirectional design.

In an additional embodiment, the final adaptation to the given scenario is performed by devices associated with the respective scenario. For example, a loudspeaker receives the reproduction session neutral modified content and adapts it to its requirements. Thus, this embodiment helps to decentralize the calculation performed by the calculator. Thus, in one embodiment, the calculator comprises a plurality of subunits located at different positions and being associated with different devices or components performing different processing steps. In an embodiment, the subunits are all part of the system. In a different embodiment, steps performed by the subunits are performed by nodes that are connected with the system.

In the following embodiments, the calculator comprises at least one subunit which performs in the respective embodiments different calculations. In some embodiments, a plurality of subunits is given and the adaptation of digital content to a reproduction session is stepwise performed by different subunits. According to an embodiment, the calculator comprises at least one subunit, wherein the subunit is configured to adapt the modified content to the reproduction session. In a further embodiment, the calculator comprises at least one subunit, wherein the subunit is configured to adapt reproduction session neutral digital content to the reproduction session. According to an embodiment, the calculator comprises a plurality of subunits.

The signal processing is performed in one embodiment centrally by a central unit, e.g. a server. In another embodiment, the processing is done in a distributed way by using subunits which are located at different positions and are associated, e.g. with the sensors or the actuators.

In an embodiment, the central unit or server calculates the filter capturing channels and the other subunits ensure that the capturing signal is synchronized with the central unit. In a further embodiment, the central unit calculates a remixing filter to optimally map the recorded digital content to the arrangement of the reproduction session.

The following embodiments deal with the at least one subunit and specify to which component or part of the system the at least one subunit belongs. In an embodiment, a sensor belonging to a recording session comprises the subunit. In an additional or alternative embodiment, the subunit is comprised by a central unit. The central unit is in one embodiment a server accessible via a web interface. In a further, alternative or additional embodiment, an actuator belonging to a reproduction session comprises the subunit.

According to an embodiment, the system comprises a central unit and a data storage. The central unit is connected to the input interface and to the output interface. The data storage is configured to store digital content and/or output digital content. The central unit and the sensors of the recording session as well as the actuators of the reproduction session are connected via a network, e.g. the internet.

In an embodiment, the data storage is one central data storage and is in a different embodiment a distributed data storage. In one embodiment, storing data also happens in components belonging to the recording session and/or belonging to the reproduction session. In one embodiment, data storage provided by the sensors and/or the actuators is used. In an embodiment, the data storage is configured to store digital content and at least one time stamp associated with the digital content.

According to an embodiment, the calculator is configured to provide a temporally coded content by performing a temporal coding on the digital content. According to an embodiment, the calculator is configured to provide a temporally coded content by performing a temporal coding on the output digital content. According to an embodiment, the calculator is configured to provide a temporally coded content by performing a temporal coding on the digital content and on the output digital content. In a further embodiment, the data storage is configured to store the temporally coded content. In an embodiment, the calculator is configured to provide a spatially coded content by performing a spatial coding on the digital content and/or the output digital content. In a further embodiment, the data storage is configured to store the spatially coded content provided by the calculator.

The coding of content reduces the data storage requirements and allows to reduce the amount of data to be transmitted via the network. Hence, in one embodiment, data reduction via coding is done at the recording side, e.g. by at least one sensor or a subunit associated with the recording session or with a sensor.

In an embodiment, the calculator is configured to adapt digital content belonging to a session (either recording or reproduction session) by calculating convex polygons and/or normal vectors based on locations associated with nodes belonging to the respective session.

According to an embodiment, the system comprises a user interface for allowing a user an access to the system. In a further embodiment, the user interface is either web-based or is a device application. In a further embodiment, a user management comprises user registration and copyright management. In an embodiment, the user interface is configured to allow a user to initiate at least one of the following sessions:

- a session comprises registering a user and/or changing a user registration and/or de-registering a user,
- a session comprises a user login or a user logout,
- a session comprises sharing a session,
- a recording session comprises recording digital content and/or uploading digital content,
- a reproduction session comprises outputting output digital content and/or reproducing output digital content, and
- a duplex session comprises a combination of a recording session and a reproduction session.

If a user wants to upload content, an embodiment provides that a name registration and/or biometric data (such as fingerprints) and other data such as email-address is needed.

With the successful registration the user is provided in an embodiment with a password.

In an embodiment, the system is configured to allow associating digital content with a specified session. Further, the system is configured to handle jointly the digital content belonging to the specified session. According to this embodiment, it is possible to combine digital content stemming from a current recording session with digital content taken by a different recording session or taken from a different or arbitrary data source. The latter data might be called offline recorded data.

In an embodiment, the uploaded data is analyzed with respect to the statistical independence e.g., using interchannel correlation based measures to determine whether the uploaded data belongs to separated sources or is multichannel mixture signal.

According to an embodiment, the specified session—mentioned in the foregoing embodiment—is associated with at least one node, wherein the node comprises a set of sensors and/or a set of actuators. The sensors or actuators also may be called devices. In one embodiment, a set of sensors comprises one sensor or a plurality of sensors. In a further embodiment, a set of actuators comprises one actuator or a plurality, i.e. at least two, actuators. In another embodiment, at least one node comprises a sensor and an actuator. In an embodiment, at least one node of a—especially reproduction—session comprises a microphone as a sensor and a loudspeaker as an actuator. In a further embodiment, at least one node comprises a smartphone comprising a sensor and an actuator.

According to an embodiment, to join a recording session, each node is to open communication ports such that an automatic synchronization accompanied with localization is possible. The nodes are assigned with locations that are accessible to all other nodes within a session. The locations might be time-variant as an algorithm for automatic synchronization localization is running during a recording session. The locations can be absolute positions (e.g., based on GPS data) and/or relative positions between the nodes.

The nodes allow in one embodiment the system to perform a sensor (e.g., microphone) calibration to identify the characteristics of each node. In such a case the calibration filters are stored in one embodiment on the corresponding device and are in a different embodiment communicated with the server being an embodiment of the central unit.

The recording session has in an embodiment a global name that can be changed only by the session initiator and each capturing channel has a name that is e.g. either generated randomly by the user front end and communicated with the server or set by the users.

The recorded content is buffered and uploaded to the central unit, the buffer size can be chosen in dependence on network bandwidth and the desired recording quality (Bit depth and sampling frequency). The higher the quality the smaller the buffer.

In an embodiment, the system is configured to initialize a time synchronization routine for the at least one node associated with the specified session, so that the sensors or actuators comprised by the node are time synchronized. Hence, due to the time synchronization routine the sensors or the actuators are time synchronized with each other. According to an embodiment, the at least one node is time synchronized by acquiring a common clock signal for the sensors or actuators comprised by the node.

In an embodiment, the system is configured to initialize a localization routine for the at least one node. This localization routine provides information about a location of the sensors and/or about the actuators comprised by the node. Alternatively or additionally, the localization routine provides information about a location of at least one signal source relative to at least one sensor comprised by the node. Additionally or alternatively, the localization routine provides information about a location of at least one consuming user relative to at least one actuator comprised by the node.

According to an embodiment, the system is configured to initialize a calibration routine for the at least one node providing calibration data for the node. The calibration routine provides data about the node and especially information about the performance of the nodes. This data is used for handling data and for providing output digital content to be reproduced in a reproduction session. The calibration of a sensor provides information about its recording characteristics while the calibration of an actuator refers in one embodiment to data describing how data reproduction is performed by the actuator.

In an embodiment, the calibration data is kept by the node. This allows the node to use the calibration data for processing the data provided by the node or to be used by the node. In an alternative or additional embodiment, the calibration data is transmitted to the central unit.

In a further embodiment, the calculator is configured to provide the output digital content based on the digital content and based on transfer functions associated with nodes belonging to the specified session—either recording or reproduction session—by decomposing a wave field of the specified session into mutually statistically independent components, where the components are projections onto basis functions, where the basis functions are based on normal vectors and the transfer functions, and where the normal vectors are based on a curve calculated based on locations associated with nodes belonging to the specified session.

In a following embodiment, the calculator is configured to divide the transfer functions in the time domain into early reflection parts and late reflection parts.

According to an embodiment, the calculator is configured to perform a lossless spatial coding on the digital content. Additionally or alternatively, the calculator is configured to perform a temporal coding on the digital content.

In an embodiment, the calculator is configured to provide a signal description for the digital content based on locations associated with nodes of the session. The signal description is given by decomposing the digital content into spatially independent signals that sum up to an omnidirectional sensor. Further, the spatially independent signals comprise a looking direction towards an actuator or a group of actuators—this is an actuator of a reproduction session—and comprise spatial nulls into directions different from the looking direction. This embodiment entails information about the positions of the nodes of the respective sessions.

In an additional or alternative embodiment, the calculator is configured to provide a signal description for the digital content based on locations associated with nodes of the session. The signal description is given by decomposing the digital content into spatially independent signals that sum up to an omnidirectional sensor. The spatially independent signals comprise a looking direction towards an actuator or a group of actuators—this is an actuator of a reproduction session—and comprise spatial nulls into directions different from the looking direction. Further, in case the actuators are spatially surrounded by the sensors (this can be derived from the respective positions), the spatial nulls correspond to sectors of quiet zones or are based on at least one focused virtual sink with directivity pattern achieved by a superposition of focused multipole sources according to a wave field synthesis and/or according to a time reversal cavity. The quiet zones are e.g. defined by [Helwani et al., 2013].

In an alternative or additional embodiment, in case that positions associated with sensors of the recording session and associated with actuators of the reproduction session, respectively, coincide within a given tolerance level, then the calculator is configured to provide the output digital content so that actuators reproduce the digital content recorded by sensors with coinciding positions. In this embodiment, the locations of at least some sensors and actuators coincide up to a given tolerance level or tolerance threshold. For this case, the output digital content is such that actuators receive the audio signals in order to reproduce the audio signals recorded by the sensors that are located at the same position.

An embodiment takes care of the case that positions associated with sensors of the recording session and associated with actuators of the reproduction session, respectively, coincide up to a spatial shift. For this case, the calculator is configured to provide the output digital content based on a compensation of the spatial shift. After the compensation of the shift, the actuators reproduce the signals recorded by the corresponding sensors (see the foregoing embodiment).

In an embodiment, the calculator is configured to provide the output digital content by performing an inverse modeling for the digital content by calculating a system inversing a room acoustic of a reproduction room of a recording session.

In a further embodiment, the calculator is configured to provide the output digital content by adapting the digital content to a virtual reproduction array and/or by extrapolating the adapted digital content to positions associated with actuators of a reproduction session.

In another embodiment, the calculator is configured to provide the output digital content based on the digital content by placing virtual sources either randomly or according to data associated with the number No of output channels. For certain numbers of output channels where each output channel is configured as an audio output channel and provides the audio signals for one loudspeaker, a specific arrangement of the loudspeakers can be assumed. For example, with two output channels it can be assumed that the two loudspeakers are such positioned to allow stereo sound. Using such an assumed arrangement, the digital content is processed in order to obtain the output digital content to be output by the output channels (in this embodiment as audio output channels) and to be reproduced by the loudspeakers.

In an embodiment, the calculator is configured to provide output digital content based on a number of actuators associated with the reproduction session. In this embodiment, the output digital content is generated according to the number of actuators belonging to the reproduction session.

According to an embodiment, the calculator is configured to remix digital content associated with a recording session accordingly to a reproduction session.

The following embodiments will be discussed concerning handling the digital content and concerning providing the output digital content.

In one embodiment, the output digital content comprises information about amplitudes and phases for audio signals to be reproduced by different actuators, e.g. loudspeakers, in a reproduction session for generating or synthesizing a wave field.

The following embodiments refer to recording sessions with sensors as nodes and to reproduction sessions with actuators as nodes.

In some embodiments, the relevant nodes are identified and used for the following calculations.

With reference to an embodiment, the calculator is configured to adapt digital content belonging to a session by calculating a centroid of an array of the nodes belonging to the session. Further, the calculator is configured to calculate the centroid based on information about locations associated with the nodes.

According to an embodiment, the calculator is configured to provide a set of remaining nodes by excluding nodes having distances between their locations and the calculated centroid greater than a given threshold. Further, the calculator is configured to calculate convex polygons based on the locations associated with the set of remaining nodes. Also, the calculator is configured to select from the calculated convex polygons a calculated convex polygon having a highest number of nodes. Additionally, the selected calculated convex polygon is forming a main array with associated nodes.

Additionally or alternatively, in an embodiment, the calculator is configured to cluster nodes having a distance below a given threshold to their respective centroid into subarrays. Further, the calculator is configured to provide the selected calculated convex polygon with regard to the subarrays.

According to an embodiment, the calculator is configured to calculate the convex polygons by applying a modified incremental convex hull algorithm.

According to an embodiment, the calculator is configured to cluster the nodes associated with the main array with regard to the information about the location.

In an embodiment, the calculator is configured to calculate normal vectors for the nodes associated with the main array performing at least the following steps:

step 1 comprising sorting locations of the nodes with respect to their inter-distances, step 2 comprising calculating a closed Bezier curve to interpolate between the nodes in a sorted order, step 3 comprising calculating a derivative of the Bezier curve, step 4 comprising calculating vectors between the nodes and the Bezier curve after excluding a node at which the Bezier curve starts and ends, step 5 comprising calculating a scalar product between the calculated vectors of step 4 and the derivative of the Bezier curve of step 3, step 6 comprising determining a normal vector of a node as a vector between the respective node and the Bezier curve by minimizing the sum of the scalar product of claim 5 and a square Euclidean norm, step 7 comprising starting at steps 2 and 3 by starting the Bezier curve with another node in order to determine the normal vector of the excluded node.

Further, the system according to an embodiment is configured to handle digital content in full duplex. A duplex session comprises a combination of a recording session and a reproduction session. The calculator is configured to perform a multichannel acoustic echo control in order to reduce echoes resulting from couplings between sensors associated with the recording session and actuators associated with the reproduction session.

A duplex session is started in one embodiment when a multichannel realtime communication is desired. In this case a recording session is simultaneously a reproduction session.

In an embodiment, a multichannel acoustic echo control such as given by [Buchner, Helwani 2013] is implemented. This is done either centrally on the central user, i.e. server side or in a distributed manner on the nodes.

The object is also achieved by a method for handling digital content.

The method comprises at least the following steps:

receiving digital content by an input interface, wherein the input interface comprises a plurality of input channels, wherein at least one input channel is configured to receive digital content from a sensor belonging to a recording session, providing output digital content by adapting the received digital content to a reproduction session in which the output digital content is to be reproduced, outputting the output digital content by an output interface, wherein the output interface comprises a plurality of output channels, wherein at least one output channel is configured to output the output digital content to an actuator belonging to the reproduction session, and wherein the digital content and/or the output digital content is transferred via a network.

Further, the digital content is received by Ni input channels, where the number Ni is based on a user interaction, and/or the output digital content is output by No output channels, where the number No is based on a user interaction. Thus, at least one number of channels (input channels and/or output channels) to be used for the transmission of data (digital content recorded in a recording session and/or output digital content to be reproduced in a reproduction session) is set by a user. In an embodiment, the number of input channels and the number of output channels is set by—different or identical—users.

The method handles digital content by receiving it via an input interface. The digital content is at least partially recorded within a recording session. Further, in one embodiment the digital content is the result of a pre-processing performed at the recording side, e.g. by a sensor.

The received digital content is adapted to be reproduced within a reproduction session. The adapted digital content is output as output digital content via an output interface. The output digital content undergoes in one embodiment some additional processing at the reproduction side.

The input interface and the output interface comprise pluralities of input channels and output channels, respectively for allowing the connection with devices used in the respective scenario.

The digital content and/or the output digital content are/is at least partially transferred via a network, i.e. via the internet.

The embodiments of the system can also be performed by steps of the method and corresponding embodiments of the method. Therefore, the explanations given for the embodiments of the system also hold for the method.

The object is also achieved by a computer program for performing, when running on a computer or a processor, the method of any of the preceding embodiments described with regard to the system.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
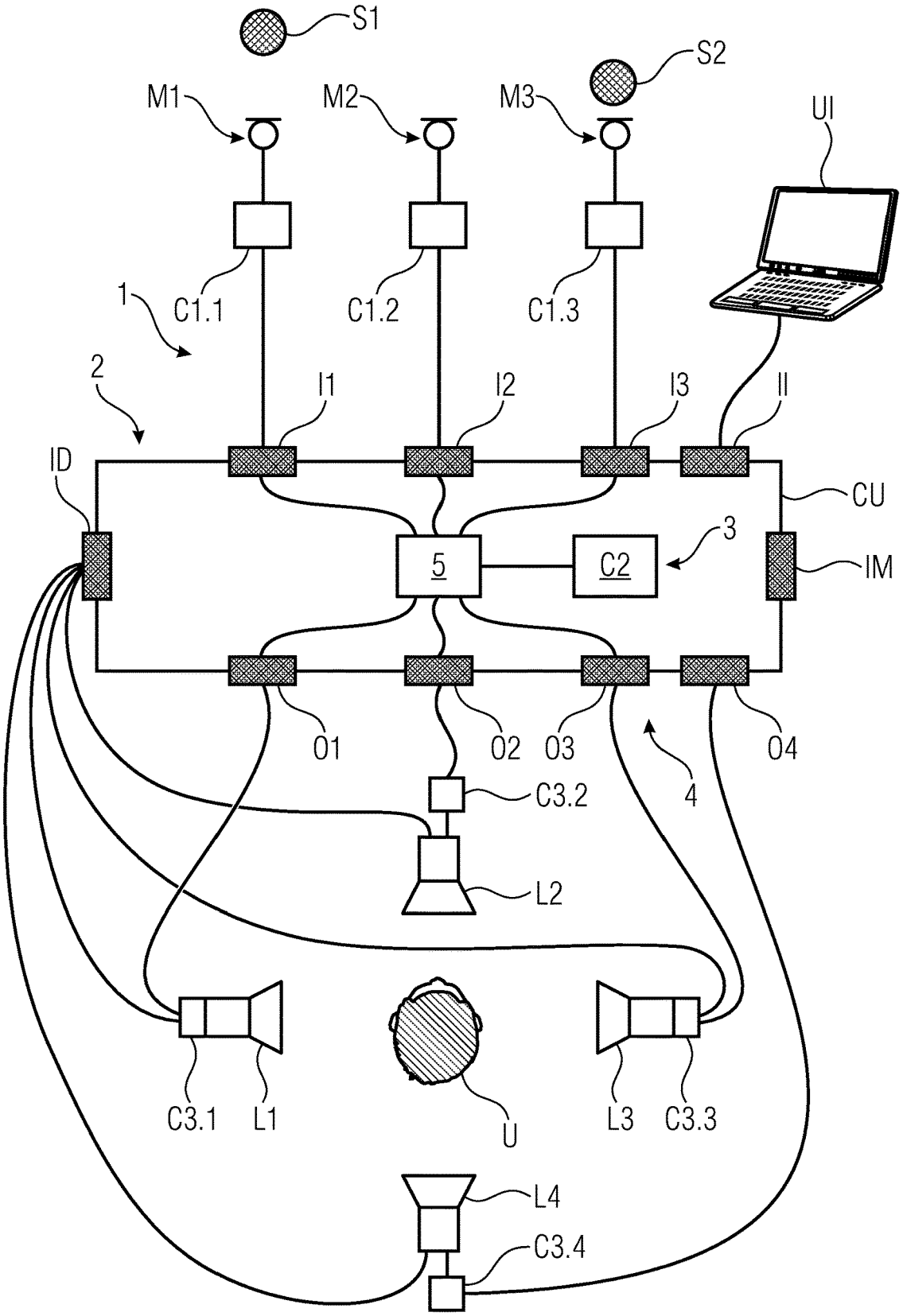
FIG. 1 shows schematically a system for handling digital content.

FIG. 1 shows an example of the system 1 handling digital content. The digital content here refers to audio signals provided by two sources S1 and S2.

The audio signals are recorded by three sensors in the form of microphones: M1, M2, and M3. The sensors M1, M2, M3 are individual nodes and belong to a recording session. The sensors belong in one embodiment to smartphones.

In a reproduction session a consuming user U is interested in hearing the audio signals.

For this purpose, four loudspeakers L1, L2, L3, and L4 serve in this embodiment for reproducing or replaying the audio signals stemming from the two sources S1, S2.

As there are in the recording session three microphones M1, M2, M3 located in front of the signal sources S1, S2 and as there are in the reproduction session four loudspeakers L1, L2, L3, L4 arranged around the user U, a suitable adaptation of the recorded content to the reproduction scenario is advisable. This is done by the system 1.

The system 1 also helps to connect different recording and reproduction sessions which are separated by space and time. This is done by the feature that the recording session—or more precisely the used sensors M1, M2, M3—and the reproduction session—or more precisely the associated actuators L1, L2, L3, L4—and a central unit CU for taking care of the digital content are connected to each other by a network, which is here realized by the internet. Hence, the drawn lines just indicate possible connections.

The possibility to consume digital content in a reproduction session at any given time after a recording session has happened is enabled by a data storage 5 comprised here by the central unit CU for storing the recorded digital data and the output digital data based on the original digital data. The data storage 5 allows in the shown embodiment to store the received digital content in connection with a time stamp.

The system 1 comprises an input interface 2 which allows to input digital content or data to the calculator 3 and here to the central unit CU. There is a network between the input interface 2, the calculator 3 and the output interface 4 which is here indicated by direct connections.

The data refers to:

- digital data or information stemming from the sensors M1, M2, M3;
- information about the actuators L1, L2, L3, L4;
- data provided by a user interface UI; and
- data belonging to different modalities such as video data, haptic/touch data, or olfactory data.

The shown input interface 2 comprises for the input of the respective data six input channels: I1, I2, I3, II, ID and IM.

Three input channels I1, I2, and I3 are associated with the individual sensors M1, M2, and M3.

One input channel II allows the user interface UI to input data. This data refers, for example, to selections by a user, to initializing sessions by the user or to uploading pre-recorded data. The pre-recorded or offline recorded data is recorded e.g. in advance of the current recording session or in a different recording session. The user adds—on the recording side of the system—the pre-recorded data to the recording session or to a reproduction session. Associating the different data with a recording or reproduction session causes the calculator 3 to handle the data jointly in at least one step while performing the adaptation of the recording data to the output content to be used in a reproduction session.

The fifth input channel ID allows the input of the information about the actuators L1, L2, L3, L4 used for the reproduction.

The sixth input channel IM serves for the input of data belonging to different modalities such as video data, haptic/touch data, or olfactory data.

At least some input channels I1, I2, I3, II, ID, IM allow in the shown embodiment not only to receive data but also to send or output data, e.g. for starting a routine in the connected components or nodes M1, M2, M3, L1, L2, L3, L4 or sending request signals and so on.

In an embodiment, the input channels I1, I2, I3 connected with the sensors M1, M2, M3 allow to initiate a calibration of the sensors M1, M2, M3, i.e. to identify the characteristics of the respective sensor M1, M2, M3. In an embodiment, the calibration data are stored on the respective sensor M1, M2, M3 and are used directly by it for adjusting the recorded digital content. In a different embodiment, the calibration data is submitted to the central unit CU.

The number Ni of input channels I1, I2, I3, actually used for the input of the audio data belonging to a recording session is set by a user. This implies that the input interface 2 offers input channels and the user decides how many channels are needed for a recording session. The user sets in one embodiment the number Ni of input channels using—in the shown embodiment—the user interface UI.

Further, the interface 2 is not limited to one location or to one area but can be distributed via its input channels I1, I2, I3, II, IM, ID to very different places.

The input interface 2 is connected to a central unit CU. The central unit CU is in one embodiment a computer and is in a different embodiment realized in a cloud. The shown central unit CU comprises a part of a calculator 3 which adapts the digital content stemming from the recording session to the requirements and possibilities of the reproduction session.

The calculator 3—according to the shown embodiment—comprises three different types of subunits C1.*i*, C2, and C3.*i*. The index i of the types of subunits C1 and C3 refers to the associated unit or node in the shown embodiment.

One type of subunit C1.*i* (here: C1.1, C1.2, C1.3) belongs to the different sensors M1, M2, M3. A different subunit C2 belongs to the central unit CU and a third type of subunit C3.*i* (here: C3.1, C3.2, C3.3, C3.4) is part of the reproduction session and is associated with the loudspeakers L1, L2, L3, L4.

The three different types of subunits C1 or C1.*i*, C2, C3 or C3.*i* help to adapt the digital content from the recording session to the reproducing session while providing modified content.

The modified content is in one embodiment the output digital content to be output to and reproduced in the reproduction session.

In a different embodiment, the modified content describes the recorded content or the reproduction in a neutral or abstract format. Hence, the modified content is in this embodiment a kind of intermediate step of adapting the digital content from the given parameters of the recording scenario via a neutral description to the constraints of the reproduction scenario.

The subunits C1.1, C1.2, C1.3 of the type C1 belonging to the sensors M1, M2, M3 convert the digital content of the microphones M1, M2, M3 from a recording session specific and, thus, sensor specific format into a neutral format. This neutral or mediating format refers, for example, to an ideal sensor detecting signals with equal intensity from all directions. Alternatively or additionally, the neutral format refers to an ideal recording situation. Generally, the neutral format lacks all references to the given recording session.

The subunits are here part of the system. In a different embodiment, the subunits are connected to the system but perform the involved processing steps.

The subunits C1 have access to information about the locations of the respective sensor M1, M2, M3 and use this information for calculating the recording session neutral digital content which is here submitted via respective input channels I2, I2, I3 to the central unit CU.

Further processing of the digital content is performed by a subunit C2 belonging to the central unit CU. This is for example the combination of digital content from different sensors or the combination with off-line recorded data etc.

The three sensors M1, M2, M3 allow an online recording of the two sound sources S1, S2. The digital content recorded by the three microphones M1, M2, M3 is buffered and uploaded to the central unit CU which is in one embodiment a server. The buffer size is chosen e.g. in dependence on network bandwidth and the desired recording quality (Bit depth and sampling frequency). For a higher quality a smaller buffer size is used.

The central unit CU also uses the input channels I1, I2, I3 for a time synchronization of the sensors M1, M2, M3 by providing a common clock signal for the sensors M1, M2, M3. Further, the central unit CU uses the input channels I1, I2, I3 for triggering the connected sensors M1, M2, M3 to submit information about their location to the central unit CU and to the subunit C2 of calculator 3.

The subunit C2—belonging to the central unit CU of the shown embodiment—allows to analyze pre-recorded or offline recorded data uploaded by the user for the respective recording session. The uploaded data is e.g. analyzed with respect to the statistical independence e.g., using interchannel correlation based measures to determine whether the uploaded channels are data of separated sources or a multichannel mixture signal. This allows to record digital content independently and to merge the content later on.

In the central unit CU, the digital content—alternatively named input digital content or received digital content—and the output digital content are stored in a data storage 5. The output digital content is calculated by the calculator 3 and the central unit CU. Relevant for the reproduction session is the output digital content.

The output digital content is transmitted via an output interface 4 to the reproduction session. This is still done via a network—e.g. via the internet—in which the system 1 is embedded or to which the system 1 is at least partially connected. The output interface 4 comprises output channels from which four channels O1, O2, O3, O4 are used in the shown embodiment to output the output digital data to four loudspeakers L1, L2, L3, L4. The number No of output channels used is based on a user input. The loudspeakers L1, L2, L3, L4 surround a consuming user U.

Especially, it is possible for users to choose the number of input channels Ni needed for a recording session as well as the number of output channels No to be used for a reproduction session.

The loudspeakers L1, L2, L3, L4 are connected to associated output channels O1, O2, O3, O4 and to subunits C3.1, C3.2, C3.3, C3.4. The subunits of the type C3 are either a part of the loudspeakers (L1 and C3.1; L3 and C3.3) or are separate additional components (C3.2 and L2; C3.4 and L4).

The subunits C3.1, C3.2, C3.3, C3.4 belonging to type C3 provide output digital content for their associated loudspeakers L1, L2, L3, L4 taking information about the loudspeakers L1, L2, L3, L4 and especially their locations into consideration. The locations of the loudspeakers L1, L2, L3, L4 may refer to their absolute positions as well as to their relative positions and also to their positions relative to the consuming user U.

The user interface UI allows in the shown embodiment a user to choose the number Ni of input channels for a recording session, i.e. the number of used sensors, and the number No of output channels for the reproduction session, i.e. the number of loudspeakers used.

Additionally, the user interface UI allows a user to initiate different kinds of sessions:

A kind of session allows steps concerning the registration of a user. Hence, in such a session a user can register, change its registration or even de-register.

In a different kind of session, a user logs in or out.

Still another session comprises sharing a session. This implies that e.g. two users participate in a session. This is, for example, a recording session. By sharing a recording session, different users can record digital content without the need to do this at the same time or at the same location.

Each started session can be joined by other registered members of the platform or the same member with a different device upon invitation or by an accepted join-request (granted knocking). Each registered device in a session will be called node. A node has optionally a set of sensors (e.g., microphones) and/or actuators (e.g., loudspeakers) and is communicating accordingly the number of input and output channels with his channel peers and the server.

A special session to be initiated is a recording session as discussed above comprising recording digital content and/or uploading digital content. Also of special interest is a reproduction session—also discussed above—comprising outputting output digital content and/or reproducing output digital content. Finally, both sessions are combined in a duplex session.

In a different embodiment, the user interface UI—which can also be named user front end—provides at a developer level the integration of plugins for further processing the raw sensor (e.g., microphone) data. Different plugins are: synchronizing signals, continuous location tracking of the capturing devices and optionally their directivity patterns.

The recording user front-end provides at a developer level the integration of plugins for the further processing of the raw sensor (e.g., microphone) data. The plugins have to be licensed by the platform operating community and is provided centrally by the operator. The platform provides natively as input for licensed plugins: synchronized signals, continuous location tracking of the capturing devices and optionally their directivity patterns.

The data storage 5 of the shown embodiment stores the digital content in a temporal as well as spatially coded format.

The received digital content is in an embodiment stored in a temporally compressed format such as Ogg Vorbis, Opus or FLAC. An embodiment especially referring to audio signals encloses recording a time stamp track additionally to the actual audio signal for each microphone M1, M2, M3. The time stamp is in one embodiment acquired from a globally provided clock signal and in a different embodiment from a session local network clock.

Also, spatial coding is used in an embodiment. The goals of the spatial coding are twofold:

1. Transforming the data such that the multiple channels in the new representation are mutually statistically independent or at least to be less dependent on each other than before the transformation. This is done, for example, in order to reduce redundancy.
2. Enabling to project the given recording setup (according to the distribution of sensor positions) to a (possibly different) reproduction setup (according to the distribution of actuator positions).

Here, different cases are realized by different embodiments. As detailed below, one embodiment is based on a statistically optimal spatial coding. Moreover, there are also realizations by embodiments based on deterministic approaches as detailed below. It has to be considered, that the statistically optimal coding scheme can also be understood as a general scheme for spatial coding which includes the deterministic ones as special cases.

An embodiment for the adaptation of the recorded data to the requirements of the reproduction session will be explained in the following.

The calculator 3 performs the adaptation. The sensors M1, M2, M3 and actuators L1, L2, L3, L4 are referred to as nodes which here include just one device each. Accordingly, the steps are used for recording as well as for reproduction sessions. Further, in the example just the location—or more precisely: the information about the location—of the node is considered. In this case, by sharing a recording and/or reproduction session, the assignment between the nodes and M1, M2, M3, L1, L2, L3, L4 is initiated.

The calculator 3 adapts the digital content belonging to a session by calculating a centroid of an array of the nodes belonging to the session using the location information. Afterwards, all nodes are excluded from further considerations, when they are farer away from the calculated centroid than a given threshold. The other nodes located closer to the centroid are kept and form a set of remaining nodes. Thus, in an embodiment the relevant nodes from the given nodes of a recording or reproduction session are identified based on their positons. Relevant are nodes in an embodiment that are close to a joint or common positon. For the remaining nodes, convex polygons are calculated. In one embodiment, the convex polygons are calculated by applying a modified incremental convex hull algorithm.

This is followed by a selection of the calculated convex polygon having the highest number of nodes. The selected calculated convex polygon forms a main array and is associated with nodes. These nodes belong to the remaining nodes and are the nodes allowing to form a convex polygon with the highest number of nodes. These associated nodes are clustered with respect to their location.

In an embodiment, the calculator 3 clusters the nodes into subarrays depending on their distance to their respective centroid. Then, the selected calculated convex polygon described above is calculated for the individual subarrays.

In an embodiment, convex and smooth polygons are used in order to calculate the normal vectors.

The foregoing is used by the calculator 3 to calculate normal vectors for the nodes that are associated with the selected calculated convex polygon, i.e. with the main array. The nodes mentioned in the following are the nodes of the polygon.

The calculator 3 performs the following steps using the different subunits C1, C2, C3:

step 1: sorting locations of the nodes with respect to their inter-distances.

step 2: calculating a closed Bezier curve to interpolate between the nodes of the polygon in a sorted order.

step 3: calculating a derivative of the Bezier curve.

step 4: calculating vectors between the nodes and the Bezier curve after excluding a node at which the Bezier curve starts and ends.

step 5: calculating a scalar product between the calculated vectors of step 4 and the derivative of the Bezier curve calculated in step 3.

step 6: determining a normal vector of a node as a vector between the respective node and the Bezier curve by minimizing the sum of the scalar product of claim 5 and a square Euclidean norm.

step 7: starting at steps 2 and 3 by starting the Bezier curve with another node in order to determine the normal vector of the excluded node.

As already mentioned, having determined the normal vectors according to the previous steps, the loudspeaker and microphone signals are preprocessed according to a spatiotemporal coding scheme in an embodiment.

In an embodiment, the loudspeaker and microphone signals are preprocessed either at the central unit CU or here the subunit C2 (e.g. a server) or locally (using the subunits C1.1, C1.2, C1.3, C3.1, C3.2, C3.3, C3.4) in a different embodiment. Hence, the nodes allow in some embodiments to perform processing steps. Processing is done according to the following steps:

1. The nodes of the recording (microphones M1, M2, M3) and synthesis parts (loudspeakers L1, L2, L3, L4) are clustered according to the aforementioned approach and convex hulls for both sides, i.e. for the recording and the reproduction session are determined. The convex hulls surround the relevant recording and reproduction areas, respectively.

2. At the recording side, the relative transfer functions between each two microphones are determined. This is done, for example, via measurements. In one embodiment, each node comprises at least one sensor and one actuator, thus, enabling measurements of the transfer functions.

Optionally, the transfer functions are approximated by the transfer functions between a loudspeaker of one node and the microphone of another by assuming that the microphone and loudspeaker of one node are spatially so close that they can be considered as being colocated. In an embodiment, the nodes are realized by smartphones comprising microphones and loudspeakers. For such devices like smartphones, it can be assumed that the microphones and loudspeakers are located at the same position.

The relative transfer function describing the acoustic path from one node to itself is measured by calculating the acoustic path of one node's loudspeaker to its microphone.

Each transfer function is divided in the time domain into early and late reflection parts resulting into two FIR filters of the length L, L'. The division is motivated by the characteristic structure of acoustic room impulse responses. Typically, the early reflections are a set of discrete reflections whose density increases until the late reflection part in which individual reflections can no longer be discriminated and/or perceived.

Modelling these two parts by two separate FIR filters, the late reflections part contains leading zeros in the time domains so that it can be realized by a filter of the same length as the one modelling the early reflections part.

The separation is done e.g., using the approach presented in [Stewart et. al].

The separated transfer functions between microphones i and j are written according to an embodiment in a convolution matrix (Sylvester Matrix $H_{ij}$) form and ordered in a blocksylvester matrix, such that two blocksylvester matrices are obtained. One for the early reflections and one for the late reflections.

For the early reflections:

$$\mathring{H}_{early} := \begin{pmatrix} H_{e,11} & H_{e,12} & \dots & H_{e,1P} \\ \vdots & \ddots & \dots & \vdots \\ H_{e,P1} & H_{e,P2} & \dots & H_{e,PP} \end{pmatrix} \tag{1}$$

with $$\mathring{H}_{e,ij} := \begin{pmatrix} h_{e,ij,0} & 0 & \dots & 0 \\ h_{e,ij,1} & h_{e,ij,0} & & \vdots \\ \vdots & h_{e,ij,1} & \ddots & 0 \\ h_{e,ij,L-1} & \vdots & & h_{e,ij,0} \\ 0 & h_{e,ij,L-1} & & 0 \\ \vdots & & \ddots & \vdots \\ 0 & \dots & 0 & h_{e,ij,L-1} \end{pmatrix}. \tag{2}$$

The notation with a circle (°) was used to distinguish the formula with the Sylvester matrices from a more compact calculation to be given in the following.

Similarly, for the late reflections:

$$\mathring{H}_{late} := \begin{pmatrix} H_{1,11} & H_{1,12} & \dots & H_{1,1P} \\ \vdots & \ddots & \dots & \vdots \\ H_{1,P1} & H_{1,P2} & \dots & H_{1,PP} \end{pmatrix}. \tag{3}$$

with components similar to that given in equation (2).

Further, a dictionary is defined as $$\Phi := \begin{pmatrix} e^{k_1^T x_1} & e^{k_2^T x_1} & \dots & e^{k_N^T x_1} \\ e^{k_1^T x_2} & e^{k_2^T x_2} & & e^{k_N^T x_2} \\ \vdots & & \ddots & \vdots \\ e^{k_1^T x_P} & \dots & e^{k_{N-1}^T x_P} & e^{k_N^T x_P} \end{pmatrix} \tag{4}$$

In the dictionary, $x_p$ is denoting the position of each localized node and $k_n$ is denoting a wave vector with the magnitude $k=\omega/c$ with omega $\omega$ denoting a radial frequency.

The dictionary is based in this embodiment on the locations of the relevant nodes and the calculated normal vectors of the respective session (either recording or reproduction session). It allows to describe the digital content—here for example either the recorded audio signals, i.e. the sensor/microphone signals or the output signals of the actuators/loudspeakers—by a transfer domain representation.

For a microphone signal Y at a frequency k captured by the given distributed microphone array, it can be written:

$$Y(k)=\Phi(k)\underline{Y}(k) \tag{5}$$

There, $\underline{Y}$ denotes the transform-domain representation of the microphone signal.

It is known that the Discrete Fourier Transform-Matrix (DFT-Matrix) diagonalizes so-called circulant matrices. This means that the DFT-Matrix is composed of the eigenvectors of circulant matrices. This relationship for circulant matrices also holds approximately for matrices with Toeplitz structure (if they are large).

A Sylvester matrix (e.g., formula (2)) is a special case of a Toeplitz matrix. Moreover, it is known that the corresponding diagonal matrix contains the frequency-domain values on its main diagonal. Hence, the matrix with the late reflections $\mathring{H}_{late}$ is transformed into the frequency domain after zero padding and by a multiplication with a blockdiagonal matrix with the DFT (Discrete Fourier Transformation)-Matrices on its main diagonal from one side and the Hermitian transposed of this block diagonal matrix from the other side.

Equivalently, for computational efficiency, the FFT (Fast Fourier Transform) is applied on the individual filters after zero padding. The resulting vectors are set as the diagonals of the submatrices in the complete blockwise diagonalized relative transfer functions matrix $\check{H}_{late}$.

Additionally, $\check{H}_{late}$ is decomposed into a set of compact matrices $H_{late}(k)$ which contain the elements of each frequency bin k. Thus, $H_{late}(k)$ contains the k-th values on the diagonals of the submatrices of $\check{H}_{late}$.

By taking the locations of the nodes into consideration, a dictionary matrix is constructed that relates a spatially subsampled (just spatially discrete sampling points of the wave fields are given by the respective nodes) loudspeaker signal in the frequency domain to a representation in a spatiotemporal transform-domain.

This representation is chosen such that the late reverberations of the relative transfer functions are sparse, for example, a dictionary of plane waves as provided by equation (4) is used.

Using the normal vectors calculated as described above, a set of plane waves $\underline{Y}_{des,OP'}$ is defined with the aim to reconstruct the given array structure.

The direction of the wave vector of each plane wave is determined by one normal vector obtained from a previous step. These plane waves are then set as the diagonal of a diagonal matrix $\underline{\Lambda}(k)$.

A matrix $\Phi^{+}(k)$ is calculated as an estimator minimizing the cost function $$J=\lambda\|vec\{\Phi^{+}H(k)\}\|_1+\|H(k)-\Phi\Phi^{+}H(k)\|_F^2, \tag{6}$$

where $H(k)=H_{late}(k)$. The cost function is given in a frequency selective form, so that $\Phi=\Phi(k)$ with the respective frequency bin k. The minimization is achieved, for example, as shown in [Helwani et al. 2014].

A filter matrix W is obtained by solving the linear system $$\underline{\Lambda}(k)=\underline{W}(k)\Phi^{+}H(k) \tag{7}$$

The spatial filters for preprocessing the microphone signals for the frequency bin k are then obtained by:

$$W(k)=\Phi(k)\underline{W}(k) \tag{8}$$

The filters for the early reflections are used to create a beamformer for each node, for a selected subset of the nodes or for virtual nodes that are obtained by interpolating the relative transfer functions with a suitable interpolation kernel such as the Green's function for sound propagation in free-field.

The beamformer is designed to exhibit spatial zeros in the directions of the other nodes, a subset of the other nodes or interpolated virtual nodes.

These beamformers $\mathring{B}$ are obtained by solving the following linear system in the time or frequency domain:

$$\mathring{\Gamma}=\mathring{H}_{early}\mathring{W}_{early} \tag{9}$$

In this formula, $\mathring{F}$ is a block diagonal matrix, whose diagonal elements are column vectors representing a pure delay filter.

The inversion can be approximated by setting the subcolumns of $\mathring{W}_{early}$ as the time reversed of the FIR filters represented in $\mathring{H}_{early}$ and by applying a spatial window. To understand the role of the window, it is helpful to understand that the calculation of $\mathring{W}_{early}$ can be done column wise. Each column calculates prefilters for all nodes to get (or to be reproduced for the reproduction session) an independent signal for one node. The window penalizes in a frequency dependent manner the nodes by multiplying the node signal with a value between 0 and 1 according to the value of the scalar product of its normal vector with the normal vector of the desired independent node. Low values have a high penalty while the highest penalty is multiplication with zero. The lower the frequency, the lower is the penalization for the nodes.

In a different and more advantageous embodiment, the inversion is done in the frequency domain by solving the system:

$$\Gamma=H_{early}W_{early} \tag{10}$$

Finally, the prefilters of the early and late reflection parts are merged to a common filter. One possible embodiment of merging the filter parts is given by the following calculation:

$$H^{-1}=(I+W_{early}H_{late})^{-1}W_{early} \tag{11}$$

An alternative embodiment of merging the filter parts is given by the calculation:

$$H^{-1}=(WH_{early}+I)^{-1}W \tag{12}$$

Here, I is denoting the unity matrix.

The calculation (11) can be understood according to the following consideration for a microphone signal y and an excitation x from loudspeakers at the same positions of the microphones or in their near proximities:

$$H_{early}^{-1}(H_{early}+H_{late})x=H_{early}^{-1}y, \tag{13}$$

$$(I+H_{early}^{-1}H_{late})x=H_{early}^{-1}y. \tag{14}$$

Further, $H_{early}^{-1}$ is approximated with $W_{early}$ and $H_{late}^{-1}$ is approximated with W.

Equation (12) is obtained in an analogous way by replacing $H_{early}^{-1}$ on both sides of (13) by W.

3. Similarly, the relative transfer functions for the reproduction session are determined and preprocessing filters represented in a matrix B are calculated. The steps for determining the transform matrix for the digital content and output digital content, i.e. concerning the recording and reproduction session, respectively, are identical.

4. The actual remixing is performed in an embodiment by prefiltering the microphone signals, and by multiplying the output with the inverse of the discretized freefield Green's function. The function is used as a multiple input/output FIR matrix representing the sound propagation between the positions of the microphones and loudspeaker after overlaying the two array geometries (one for the recording session and one for the reproduction session) in one plane with coinciding centroids and at a by the user determined rotation angle or a randomly chosen rotation angle.

The Green's function G describes the undisturbed or free field propagation from the sources—here the locations of the sensors—in the recording room to the sinks—here the actuator locations—in the reproduction room.

Performing the inversion of the Green's function matrix incorporates a predelay in the forward filters representing the Green's function especially in the case where the position of a recording node after the overlay process lies within the chosen convex hull at the reproduction side.

The loudspeakers signal is obtained by convolving the filtered microphone signals with the inverse of the Green's function calculated previously and then with the calculated beamformer inverse of the relative transfer function as described in the last step.

If the position of the microphone in a recording is unknown but the recording is compatible with a legacy format such as stereo, 5.1, 22.2, etc. the microphones corresponding to each recording channel are thought as virtual microphones set at the positions recommended by the corresponding standard.

5. For the reproduction session, several subarrays are involved e.g. in the synthesis of a prefiltered microphone signal according to the previously presented steps.

Subarrays allow to reduce the complexity of the calculations. In an embodiment, using subarrays is based on the embodiment in which the nodes contain more than one sensor and/or more than one actuator.

The previously described embodiment of spatial coding can be regarded as a statistically optimal realization according to the cost function (6). Alternatively, a simplified deterministic spatial coding can be used in an embodiment.

Here, different cases are realized by different embodiments:

Case a

The original "native" channels, i.e. the original digital content is kept by a lossless spatial coding. In an embodiment, each of these channels is then coded temporally.

Case b

Case b.1: If the rendering setup (i.e. the location of the loudspeakers or actuators of the reproduction session) is known at the capturing time of the recording session, then a signal description, i.e. a description of the digital content is given by decomposing the signal into spatially independent signals that sum up to an omnidirectional microphone. Spatially independent implies to create a beam pattern having a looking direction into one loudspeaker and exhibiting spatial nulls into the direction of the other beam formers. The level of each beam is normalized such that summing up the signals results in an omnidirectional signal. If the position of the loudspeakers is unknown and the multichannel recording is given by Q signals, optimally, Q beams each with Q−1 spatial nulls are created. Filtering the microphone signals with those constrained beam formers gives Q independent spatial signals that corresponds ideally with a localized independent source.

Case b.2: If the rendering loudspeaker setup is located within the area surrounded by the recording microphone array, then the spatial nulls (with regard to the direction of arrival (DOA), i.e. the angle) correspond to sectors of quiet zones according to [Helwani et al., 2013] or by synthesizing a focused virtual sink with directivity pattern which can be achieved by a superposition of focused multipole sources according to the WFS (wave field synthesis) theory and time reversal cavity [Fink]. These sectors of quiet zones are centered around the center of gravity of the area enclosed by the microphone array.

Case b.3.1: If the two manifolds of the recording session and reproduction session approximately coincide according to a predefined region of tolerance, each loudspeaker playbacks the sound recorded by each microphone.

Case b.3.2: If the manifolds defined by the sensors and the actuator distribution are approximately the same up to a certain shift, then this shift is compensated by the reproduction filter.

Case b.4: Inverse modeling by calculating a system that inverses the room acoustic of the reproduction room, in frequency selective and by assuming free-field propagation unless the acoustic of the reproduction room is known.

Case c

In the more general case, if the setup of the reproduction session is not known at the capturing time of the recording session, virtual reproduction array is assumed and the scheme according to case b is applied. From this virtual array, the wave field is then extrapolated to the actual loudspeaker positions in the reproduction room using WFS [Spors] techniques to synthesize virtual focused sound sources. Hereby the elements of the virtual loudspeaker array are treated as new sound sources.

Case d

The spatial codec imports multichannel audio signals without metadata by placing virtual sources either randomly for each channel or according to a lookup table that corresponds certain channel number e.g., 6 channels, with a legacy multichannel setup such as 5.1 or 2 channels are treated as stereo with 2 virtual sources such as a listener at the centroid of the array has an impression of two sources at 30° and −30°.

In a further embodiment a reduction of the number of channels is performed.

In one version, a principal component analysis (PCA) or an independent component analysis (ICA) is performed across the channels after the beam forming stage in order to reduce the number of channels. The temporal delays between the individual channels are compensated before the (memoryless) PCA is applied [Hyvarinen]. Delay compensations and PCA are calculated in a block-by-block manner and saved in a separate data stream. The above mentioned temporal coding is then applied to each of the resulting channels of the beam former outputs or the optional PCA outputs.

Other embodiments for the remixing are based on the following remixing techniques in the case that the digital content refers to audio signals:

In case of Higher Order Ambisonics (HOA) [Daniel] order j-to-k with j>k: Spatial band stop is applied on the first k coefficients of the spherical harmonics to obtain a lower ambisonics signal which can be played back with a lower number of loudspeakers. The number j is the number of input channels, and k is the number of output channels as input and output channels of a remixing step.

In the case of k>j, compressed sensing regularization (analogously to the criterion (6)) on the regularity of the sound field (sparsity of the total variation) [Candés].

In the case of N-to-Binaural, i.e. in the case of reducing N input channels to a reproduction using earphones:

For allowing a consuming user U to listen to a multichannel recorded signal as digital content with an arbitrary number of microphones as sensors located at random known locations, a virtual array of loudspeakers (vL1, vL2, vL3) emulated with a dataset of Head-Related Transfer Functions (HRTF) is used to create a virtual sink at the position of the real microphones.

Figure 2:
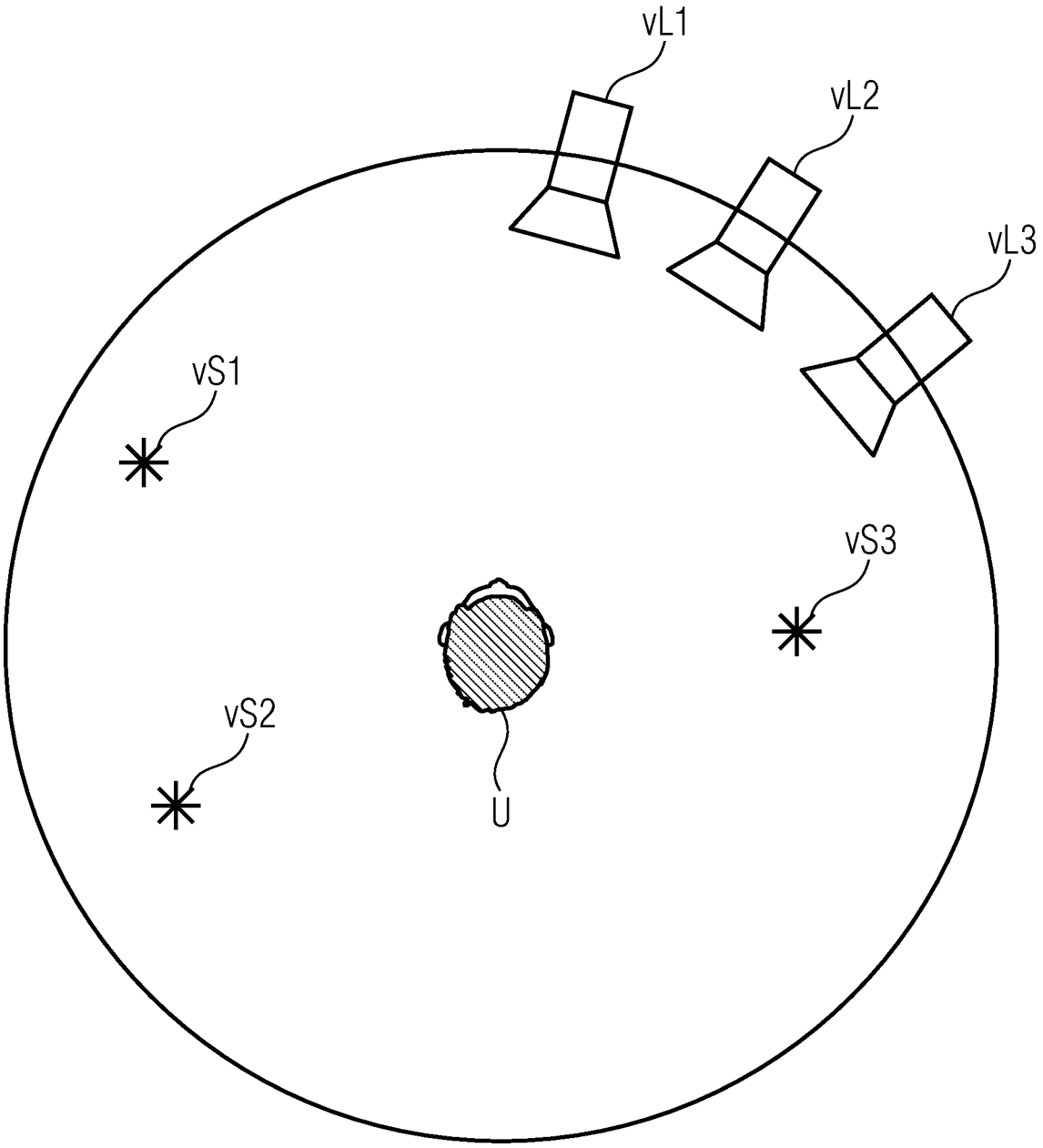
FIG. 2 illustrates a scenario of a reproduction session.

The signal as digital content is convolved with the focusing operator first and then with the set of HRTFs as shown in FIG. 2 resulting in a binaural signal. Focused sinks at random positons (vS1, vS2, vS3) are generated in one embodiment by focusing operator used in the wave field synthesis techniques. The focusing, for example, is done based on the time reversal cavity and the Kirchhoff-Helmholtz integral.

The position of the focused sinks is related to the position of the recording microphone.

Hence in one embodiment, the HRTFs are prefiltered by the focusing operator which is, for example, modelled as a SIMO (Single Input/Multiple Output) FIR (Finite Impulse Response) filter with N as the number of the HRTF pairs (e.g., two filters for the left and right ears at each degree of the unit circle) and the length L as resulting from the Kirchhoff-Helmholtz integral.

Multichannel output is convolved with the HRTF pairs resulting in a MIMO (Multiple Input Multiple Output) system of N inputs and two outputs and a filter length determined by the length of the HRTF length.

Different application cases are possible:

N-to-M with N separated input signals:

In this case the separated input channels are considered as point sources of a synthetic soundfield. For the synthesis higher order ambisonics, wave field synthesis technique or panning techniques are used.

5.1 Surround-to-M:

A 5.1 file is rendered by synthesizing a sound field with six sources at the recommended locations of the loudspeakers in a 5.1 specification.

In one embodiment, the adaptation of the digital content recorded in a recording session to the reproduction in a reproduction session happens by the following steps:

For the recording, a given number Q of smartphones are used as sensors. These are placed randomly in a capturing room or recording scenario. The sound sources are surrounding the microphones and no sound source is in an area enclosed by the sensors.

The recording session is started, in which the sensors/microphones/smartphones as capturing devices are synchronized by acquiring a common clock signal. The devices perform a localization algorithm and send their (relative) locations to the central unit as metadata as a well as GPS data (absolute locations).

The spatial sound scene coding is performed targeting a virtual circular loudspeaker array with a number Q' of Q elements and surrounding the smartphones wherein Q'<=Q. Accordingly, Q' Beamformers each having (Q'−1) nulls are created with the nullsteering technique [Brandstein, ward Microphone arrays].

The microphone signals are filtered with the designed beamformer and a channel reduction procedure is initialized based on a PCA technique [Hyvarinen] with a heuristically defined threshold allowing to reduce the number of channels by ignoring eigenvalues lower than this threshold. Hence, the PCA provides a downmix matrix with Q' Column and D<=Q' rows.

The filtered signals are multiplied with the downmix matrix resulting in D eigenchannels. These D channels are temporally coded using, for example, Ogg Vorbis. The eigenvectors of the Downmix Matrix are stored as metadata. All metadata are compressed using e.g. a lossless coding scheme such as Huffmann codec. This is done by the calculator 3 which is partially located, for example, via subunits C1 (i=1, . . . , 4) at the individual sensors Mi (i=1, . . . , 4).

Reproduction of the digital content recorded in the recording session is done with P loudspeakers that can be accurately localized and start a reproduction session as described above.

The P (here P=4) loudspeakers L1, L2, L3, L4 receive the D (here also D=4) channels from the central unit CU which can also be named as platform and upmix the eigenchannels according to the downmix matrix stored in the metadata. The upmix matrix is the pseudoinverse of the downmix matrix. Accordingly, the calculator 3 comprises subunits C3.*i* (i=1, . . . , 4) located within the reproduction session adapting the reproduction session neutral modified content to the current reproduction session.

The array is then synthesizing according to the location of the loudspeakers L1, L2, L3, L4 as actuators, and according to the description in the reproduction session, virtual sources at the position of the virtual loudspeakers assumed while the recording session.

Figure 3:
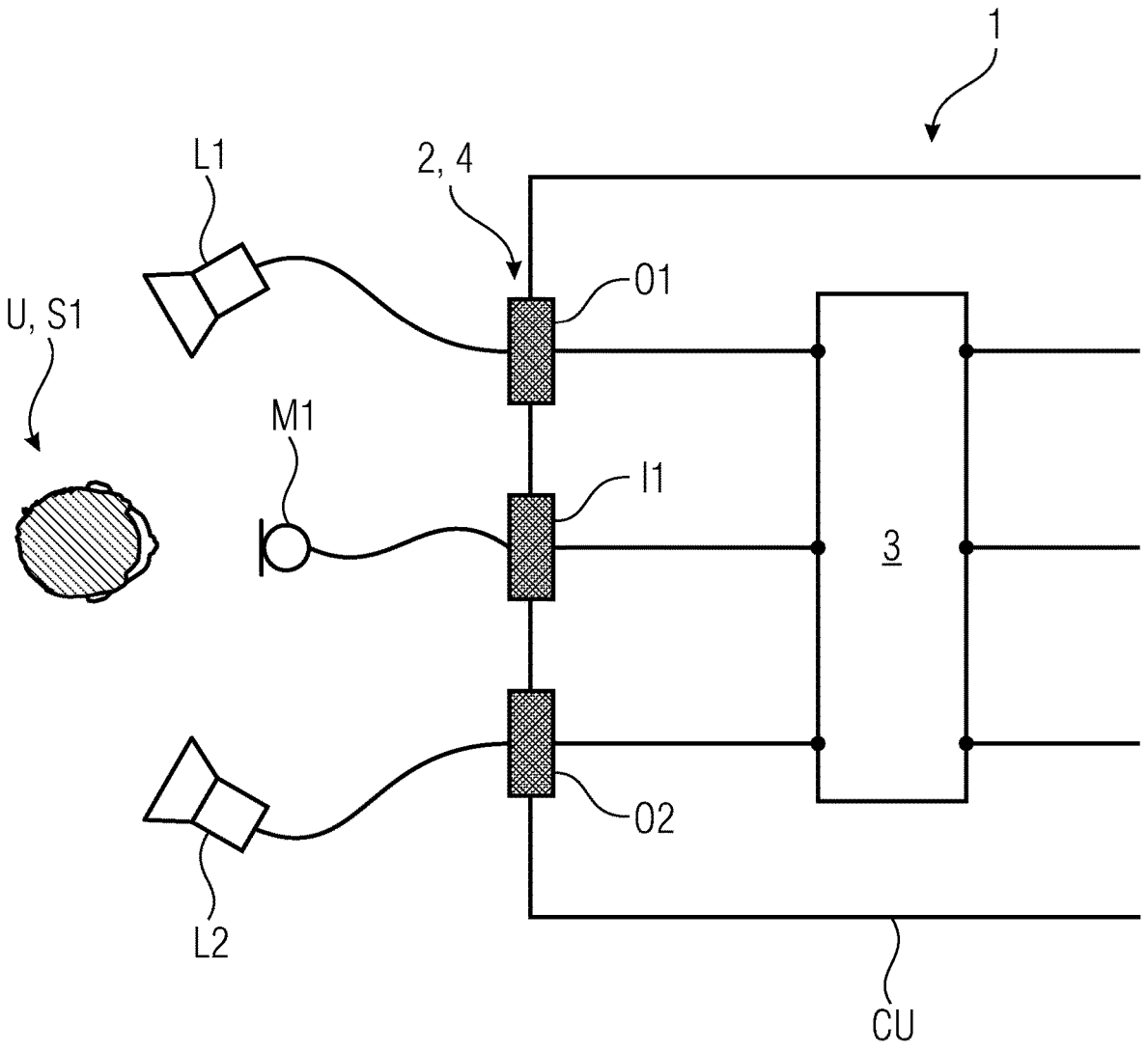
FIG. 3 shows a part of a duplex session.

FIG. 3 shows a part of a duplex session realized by the system 1.

A duplex communication system is a point-to-point system allowing parties to communicate with each other. In a full duplex system, both parties can communicate with each other simultaneously.

Here, just one party with one user is shown. In the duplex session, the user is a signal source S1 for a recording session and also a consuming user U for the reproduction session. Hence, a duplex session is a combination of these two different sessions.

With regard to the recording session, the audio signals of the user as a content source S1 are recorded by a microphone as sensor M1. The resulting digital content is submitted via the input channel I1 of the input interface 2 to the central unit CU. The digital content is received by the central unit CU and is used by the calculator 3 for providing output digital content. This output digital content is output at the other—not shown—side of the central unit CU connected with the other communication party.

In the shown embodiment, the calculator 3 is completely integrated within the central unit CU and performs here all calculations for adapting the recorded data to the reproduction session.

At the same time, the user is a consuming user U listening to the audio signals provided by the two actuators L1, L2. The actuators L1, L2 are connected to the two output channels O1, O2 of the output interface 4.

If a duplex session is started, the nodes (here: the two loudspeaker L1, L2 and the microphone M1) provide information about their electroacoustical I/O interfaces and about their locations or about the location of the content source S1 and the consuming user U. Optionally, they allow a calibration, for example, initiated by the central unit CU.

In the shown embodiment, the data storage is omitted as a realtime communication is desired.

In an embodiment, a multichannel acoustic echo control such as, for example, described in [Buchner, Helwani 2013] is implemented. In one embodiment, this is done centrally at the calculator 3. In a different embodiment, this is performed in a distributed manner on the nodes L1, L2, M1.

Figure 4:
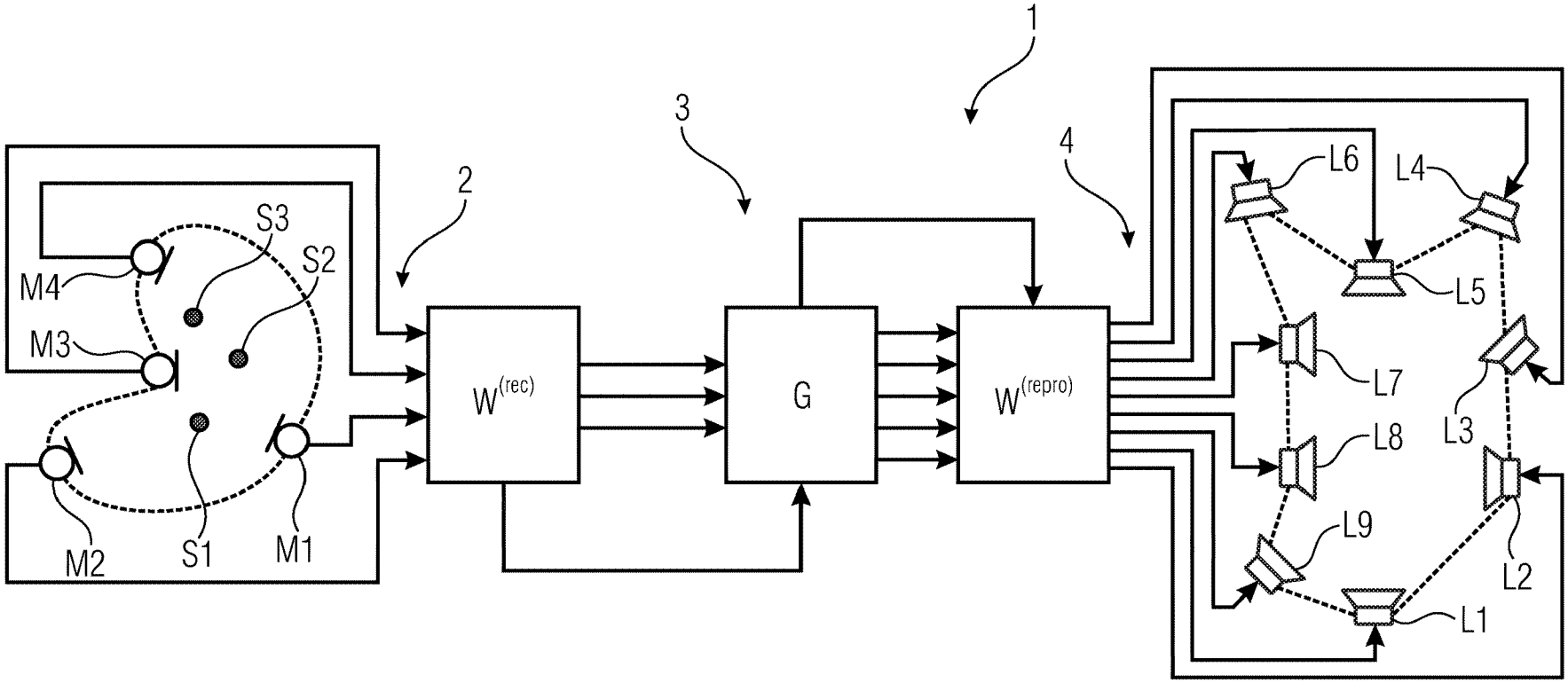
FIG. 4 shows a further embodiment of a system for handling digital content.

In FIG. 4 a system for handling digital content 1 is shown as a high-level overview of the whole transmission chain for multichannel audio from the recording side using a distributed ad-hoc microphone array to the reproduction side using a distributed ad-hoc loudspeaker array.

Here, four microphones M1, M2, M3, M4 record audio signals stemming from three sources S1, S2, S3. The respective audio signals are transmitted as digital content using the input interface 2 to the calculator 3. The calculated output digital content comprising audio signals appropriate to the reproduction session is output via the output interface 4 to nine loudspeakers L1 . . . L9. This shows that the calculator 3 has to adapt the digital content recorded by four microphones to the requirements of a reproduction session using nine loudspeaker. In the reproduction session a wave field is generated by applying the output digital content with different amplitudes and different phases to the individual loudspeakers L1 . . . L9.

Due to the ad-hoc setups, the array geometries—on the recording and/or reproduction side—are not known in advance, and typically the setup on the reproduction side will differ from the setup on the recording side. Hence, the transmission is performed in the shown embodiment in a "neutral" format that is independent of the array geometries and, ideally, also independent of the local acoustics in the reproduction room. The calculations for the transmission are performed by the calculator 2 and are here summarized by three steps performed e.g. by different subunits or only by a server as a central unit: $W^{(rec)}$, G, and $w^{(repro)}$.

On the recording side, the filter matrix $W^{(rec)}$ produces the spatially neutral format from the sensor array data, i.e. from the recorded digital content.

Using the neutral format, the data are transmitted (note that on each component of the neutral format in one embodiment a temporal coding is additionally applied) and processed by the filter matrix G. Specifically, for reproducing the signals on the reproduction side by placing (recorded) source signals on specific geometrical positions, the matrix G is the freefield Green's function.

Finally, the filter matrix $W^{(repro)}$ creates the driving signals of the loudspeakers by taking into account the actual locations of the loudspeakers and the acoustics of the reproduction room.

The calculation steps of the two transformation matrices $W^{(rec)}$ and $W^{(repro)}$ are analogous and are described below.

Without loss of generality, only the steps for the reproduction side are described in the following.

As a special case, the block diagram of FIG. 4 also includes the synthesis based on the positioning of virtual loudspeakers. In this case, the Green's function G directly places virtual sources on certain given geometrical positions. Afterwards, using the reproduction matrix, the room acoustics and the array geometry in the particular reproduction room are taken into account using $W^{(repro)}$ as described in the following.

The overall goal of the embodiment is a decomposition of the wave field into mutually statistically independent components, where these signal components are projections onto certain basis functions.

The number of mutually independent components does not have to be the same as the number of identified normal vectors (based on the convex hulls). If the number of components is greater than the number of normal vectors, then the possibility is given of using linear combinations of multiple components. This allows for interpolations in order to obtain higher-resolution results.

It follows a summary of steps to calculate an equalization filter matrix W shown exemplarily for the reproduction side, i.e., $W=W^{(repro)}$.

1. Measure the acoustic impulse responses between the nodes of the distributed reproduction system. In one embodiment, a close proximity of loudspeaker and corresponding microphone is assumed within each of the nodes so that they can be considered as being colocated. The impulse responses from each of the nodes to itself are also measured ("relative transfer function"). In total this gives a whole matrix of impulse responses.
2. Localize the relative geometric positions of the nodes of the reproduction system.
3. Based on the result of step 2, calculate the convex hull (e.g. Bezier curve) through the nodes and calculate the normal vectors (in one embodiment according to the above described seven steps).
4. For equalization of the reproduction room and normalization of the loudspeaker array geometry:

Each transfer function is divided in the time domain into early and late reflection parts, i.e., $H=H^{early}+H^{late}$. An equivalent formulation using convolution matrices is given by equations (1) through (3).

4.1. To estimate the equalization filter based on the late reflections:

4.1.1. Calculate the frequency-domain representation of the late-reflection part of the measured impulse response matrix, $H^{late}(k)$, where k denotes the number of the frequency bin.

4.1.2. Define matrix $\Phi$ according to equation (4) using the positions of the nodes and the normal vectors (steps 2 and 3 above). The elements of $\Phi$ can be regarded as plane waves which will be used as basis vectors in the following steps. The vectors $x_i$ are positon vectors of the nodes, i.e. of the sensors and/or actuators, and are, thus, spatial sampling points. The vectors $k_i$ are wave vectors having directions of the normal vectors of the convex hull.

4.1.3. By minimizing the cost function (6), the matrix $\Phi^+$ is obtained from $\Phi$ and from $H_{late}(k)$. This optimization reconstructs a set of plane waves from the spatial sampling points. Due to the $I_1$ norm in (6), the matrix $\Phi^+$ will be optimized in such a way that the vector $vec(\Phi^+H_{late}(k))$ describes the minimum number of plane waves (sparseness constraint). Hence, the system $H_{late}(k)$ is represented in a lower-dimensional transform domain by decomposing it in a statistically optimal way into plain wave components.

4.1.4. The equalization filter $\underline{W}(k)$ in the compressed domain in obtained by solving equation (7) for $\underline{W}(k)$, e.g., using the Moore-Penrose pseudoinverse. Here, $\underline{\Lambda}(k)$ is a diagonal matrix containing plain waves according to the array normal vectors from above as the target.

4.1.5. The equalization filter $W(k)=W_{late}(k)$ in the original (higher-dimensional) domain is obtained from W(k) according to equation (8).

4.2. To estimate the equalization filter based on the early reflections: Solve equation (9) for the equalization filter $W_{early}$. This calculation is performed in the frequency domain according to equation (10).

4.3. The overall equalization filter is obtained by merging the early and the late reflection parts according to equation (11) or equation (12).

Using the late reflection part is based on the discovery that the calculations are more stable.

The arrows between the filter matrices $W^{(rec)}$, $W^{(repro)}$ and G indicate that information about calculated or predefined locations is submitted to the subsequent step. This means that the information about the calculated location of the calculated virtual audio objects is used for the step calculating the virtual microphone signals and that the information of the predefined locations of the virtual microphones is used for obtaining the filter matrix $W^{(repro)}$ for generating the audio signals to be reproduced within the reproduction session.

Figure 5:
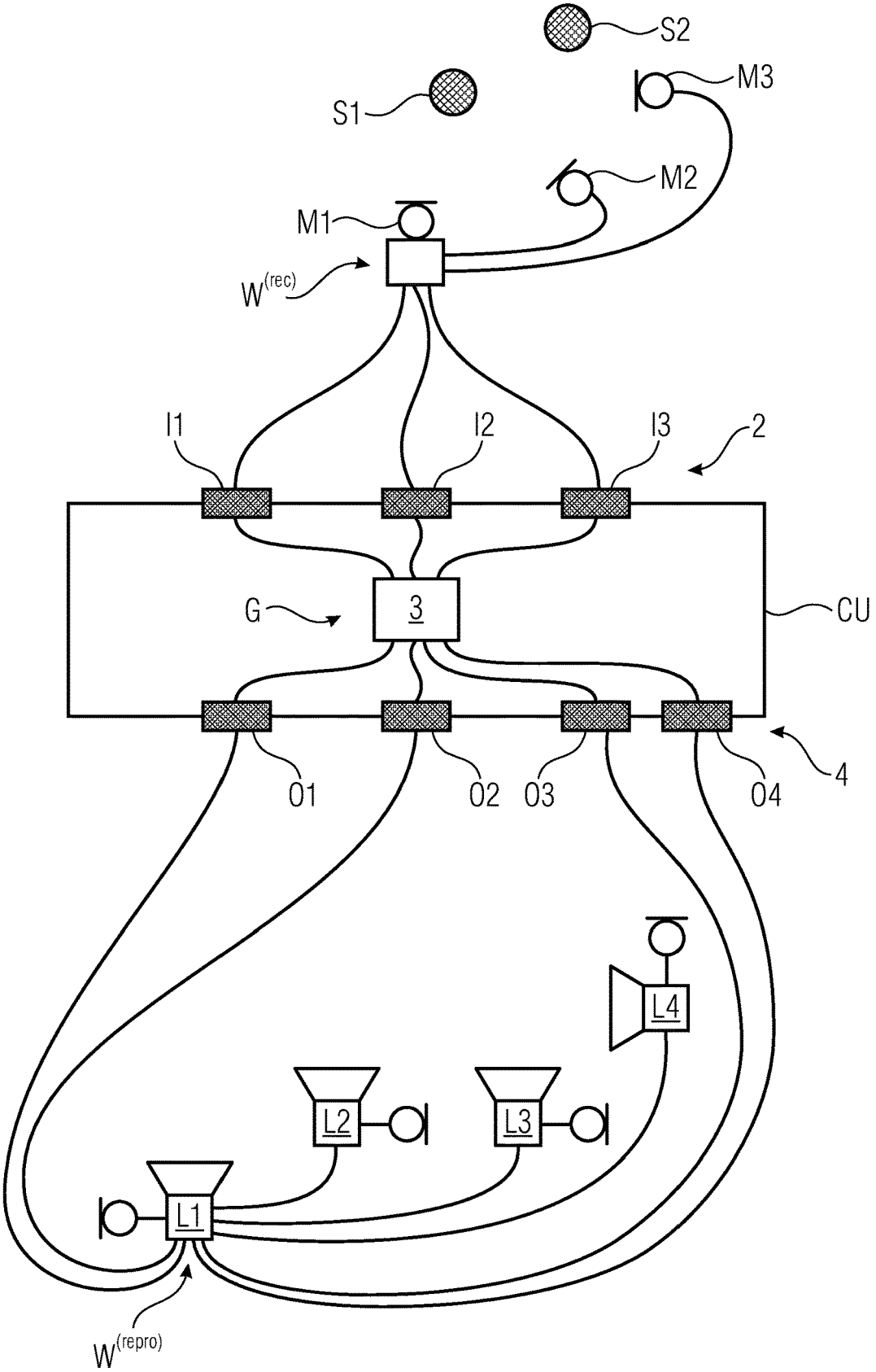
FIG. 5 shows a schematic system for handling digital content.
Figure 6D:
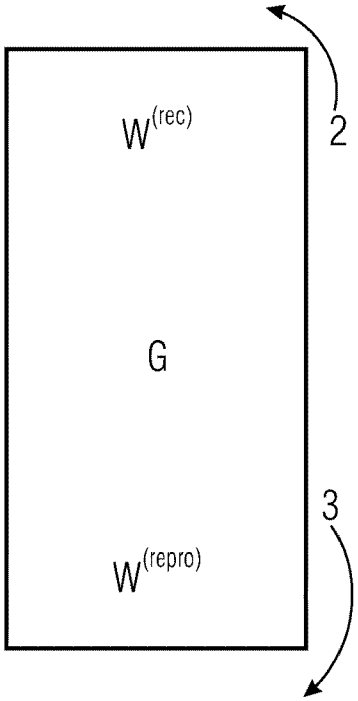
FIG. 6 shows four different possible assignments and bundles of the different processing steps (FIG. 6 *a*)-*d*))
Figure 6C:
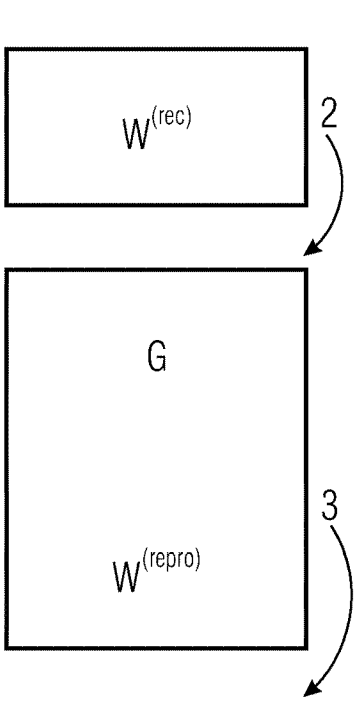
Figure 6B:
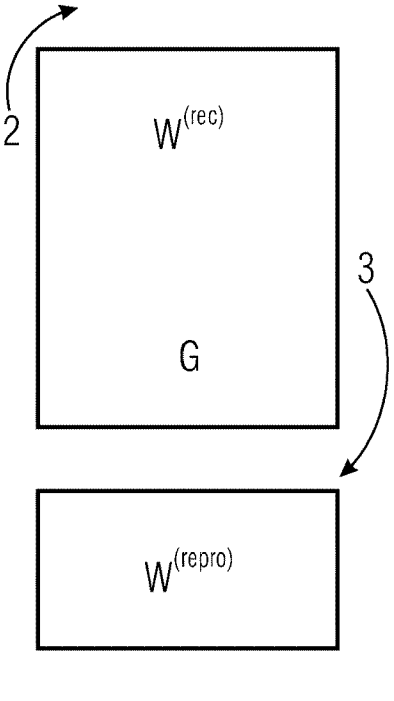
Figure 6A:
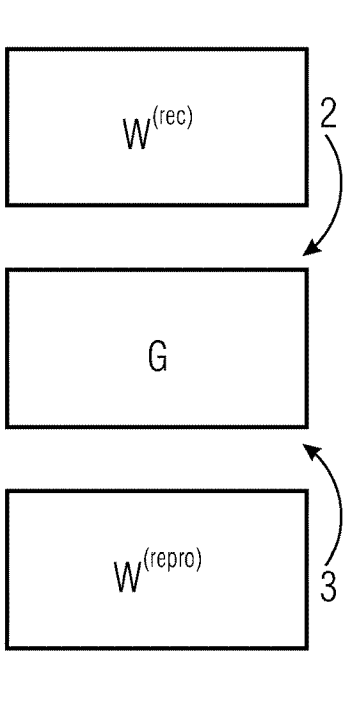

In FIG. 5, another embodiment of the system 1 is shown.

For the adaptation of the recorded audio signals to the reproduction session, two filter matrices $W^{(rec)}$ and $W^{(repro)}$ and a Green's function G are calculated as explained above. From which units of the shown embodiment the matrices $W^{(rec)}$, $W^{(repro)}$ and the function G are provided is indicated in the drawing by arrows.

The central unit CU of the shown embodiment comprising the calculator 3 for providing the output digital content and comprising the input interface 2 as well as the output interface 4 is here realized as a server. The network connecting the input interface 2, the calculator 3, and the output interface 4 can be realized—at least partially—directly via a hardware connection (e.g. cables) within the server or e.g. via distributed elements connected by a wireless network.

The central unit CU provides various input interface channels I1, I2, I3 and various output interface channels O1, O2, O3, O4. A user at the recording session and a user at the reproduction session determine the number of actually needed channels for the respective session.

At the recording session, three sensors (here microphones) M1, M2, M3 are used for recording audio signals from two signal sources S1, S2. Two sensors M2 and M3 submit their respective signals to the third sensor M1 which is in the shown embodiment enabled to process the audio signals based on the filter matrix $W^{(rec)}$ of the recording session. Hence, in this embodiment, the preprocessing of the recorded signals is not performed by each sensor individually but by one sensor. This allows, for example, to use differently sophisticated sensors for the recording. The preprocessing of the recorded signals using the filter matrix $W^{(rec)}$ provides digital content to be transmitted to the input interface 2 in a recording session neutral format.

In one embodiment, this is done by calculating—for example based on the positons of the sensors M1, M2, M3 and/or their recording characteristics and/or their respective transfer functions—audio objects as sources of calculated audio signals that together provide a wave field identical or similar to the wave field given within the recording session and recorded by the sensors. These calculated audio signals are less dependent on each other than the recorded audio signals. In an embodiment, it is strived for mutually independent objects.

Hence, in an embodiment, the preprocessing at the side of the recording session provides digital content for processed audio signals recorded in the recording session. In an additional embodiment, the digital content also comprises metadata describing the positions of the calculated virtual audio objects. The processed audio signals of the digital content are the recorded audio signals in a neutral format implying that a dependency on the constrictions of the given recording session is reduced. In an embodiment, the digital content is provided based on transfer functions of the sensors M1, M2, M3. In a further embodiment, the transfer functions are used based on the above discussed splitting into late and early reflections.

The digital content is submitted to the three input channels I1,I2,I3 of the input interface 2 of the server, for example, via the internet. In a different or additional embodiment, the digital content is submitted via any phone or mobile phone connection.

The calculator 3 receives the digital content comprising the calculated audio signals and—as metadata—the information about the positions of the calculated virtual audio objects.

The calculator 3 of the central unit CU calculates based on the digital content and using a filter matrix that is in one embodiment Green's function G signals for virtual microphones that are located at predefined or set locations. In one embodiment, the virtual microphones are such positioned that they surround the positions of the sensors and/or the positions of the calculated virtual audio objects. In an embodiment, they are located on a circle.

Thus, the calculator 3 receives the calculated audio signals that are dependent on the positions of the calculated virtual audio objects. Based on these signals, the calculator 3 provides virtual microphone signals for virtual microphones. The output digital content comprises these virtual microphone signals for the virtual microphones and comprises in one embodiment the positions of the virtual microphones as metadata. In a different embodiment, the positions are known to the receiving actuators or any other element receiving data from the output interface 4 so that the positions have not to be transmitted. The virtual microphone signals for the virtual microphones are independent of any constraint of the recording and the reproduction session, especially independent of the locations of the respective nodes (sensors or actuators) and the respective transfer functions. The virtual microphone signals for virtual microphones are output via the output channels O1, O2, O3, O4 of the output interface 4.

On the receiving side of the output digital content (i.e. at the reproduction side) the output digital content is received by one actuator L1 that adapts the output digital content to the requirements of the given reproduction session. The adaptation of the digital output data to the number and location of the actuators is done using the filter matrix $W^{(repro)}$. In order to gather the information about the actuators L1, L2, L3, L4, each actuator is provided with a microphone. The microphones allow e.g. to obtain information about the output characteristics, the positions and the transfer functions of the actuators.

The system 1 consists of a server as a central unit CU. Sensors M1, M2, M3 record audio signals from signal sources S1, S2 and—here realized by one sensor—provide digital data comprising calculated audio signals describing calculated virtual audio objects located at calculated positions. The calculator 3 provides based on the received digital content the output digital content with signals for virtual microphones wherein the signals for the virtual microphones generate a wave field comparable to that associated with the calculated audio signals of the calculated virtual audio objects. This output digital content is adapted afterwards to the parameters and situations of the reproduction session.

The adaptation of the recorded audio signals with the conditions of the recording session to the conditions of the reproduction session, thus, comprises three large blocks with different types of "transformations":

First, transforming the recorded signals into calculated audio signals of calculated virtual audio objects located at calculated positions (this is done using the filter matrix $W^{(rec)}$). Second, transforming the calculated audio signals into virtual microphone signals for virtual microphones located at set positions (this is done using the Green's function as an example for a filter matrix G).

Third, transforming the virtual microphone signals for the virtual microphones into the signals that are to be reproduced by the actually given reproduction session (for this is used the filter matrix $W^{(repro)}$).

As above mentioned, the calculator 3 comprises in an embodiment different sub units. The embodiment of FIG. 5 refers to a system in which the sensors and actuators are enabled to perform steps on their own so that the calculator 3 just performs the second step. In different embodiments, the subunits are combined with intelligent sensors and/or actuators so that they are connected with the system but do not form part of it.

Some examples about where which steps are performed are given by FIG. 6. The input 2 and output interfaces 3 indicate the boundaries of the system for these embodiments.

In FIG. 6 *a*), the three steps mentioned above are handled in the shown embodiment by sensors and actuators connected to a central unit of the system comprising a calculator.

In FIG. 6 *b*), the digital content is given by the recorded audio signals provided by different sensors. These signals are processed by the calculator as part of a server and are submitted as output digital content after the first and second step to at least one actuator capable for adapting the signals for the virtual microphones to the given reproduction session (i.e. performing the third step including the filter matrix $W^{(repro)}$).

The embodiment of FIG. 6 *c*) comprises a recording session providing the digital content in a recording session neutral format (after the first step and using the filter matrix $W^{(rec)}$). The afterwards calculated output digital content (based on the second and third step) comprises the actual signals submitted to the actuators of the reproduction session.

Finally, the embodiment FIG. 6 *d*) shows a system where all calculations are performed by a central unit receiving the recorded audio signals directly from the sensors and providing output digital content to the actuators that can directly be used by the actuators as the output digital content is already adapted to the reproduction session.

Figure 7A:
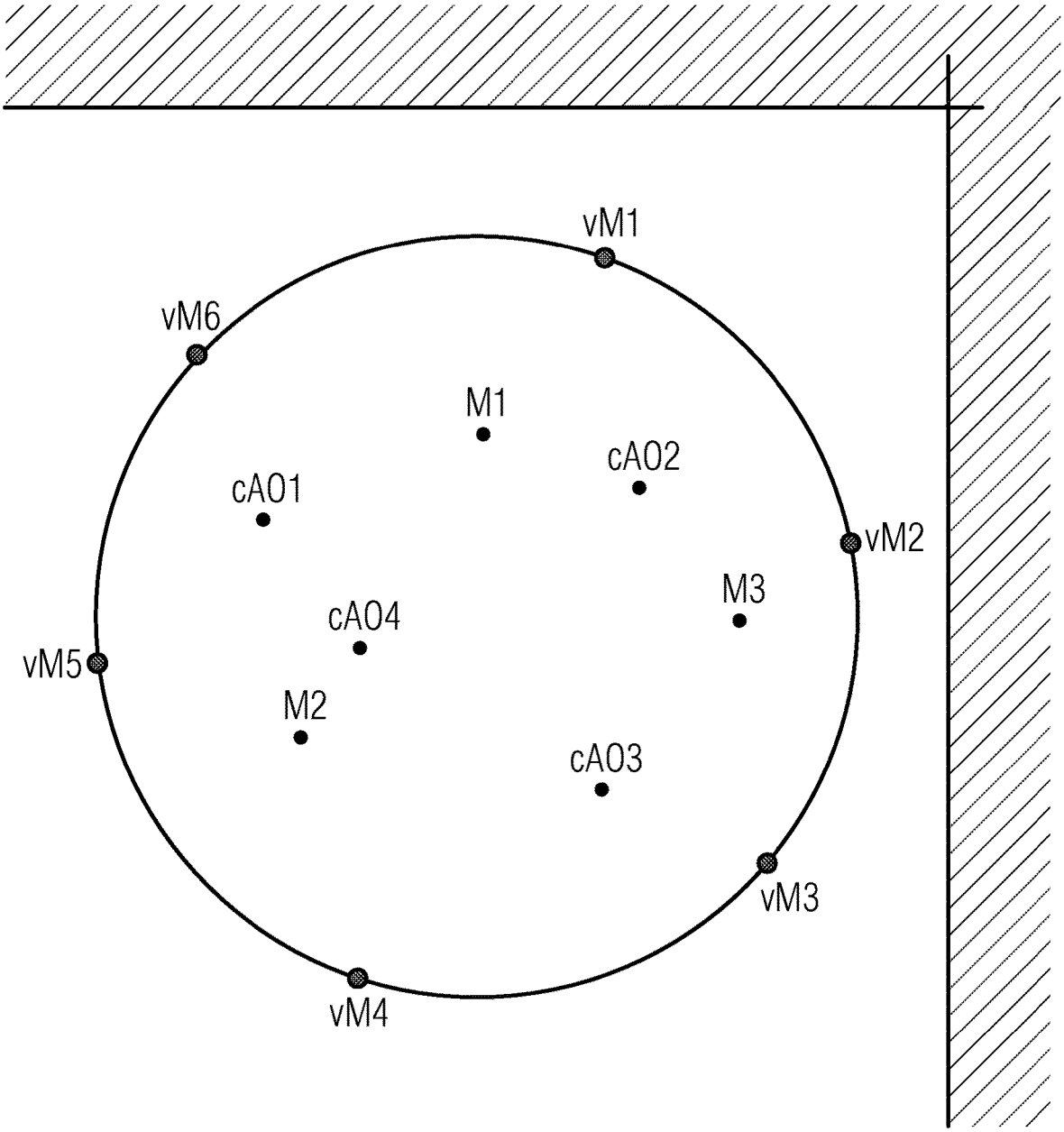
FIGS. 7*a* and 7*b* illustrate the different calculation steps from the audio sources to the reproduction session.
Figure 7B:
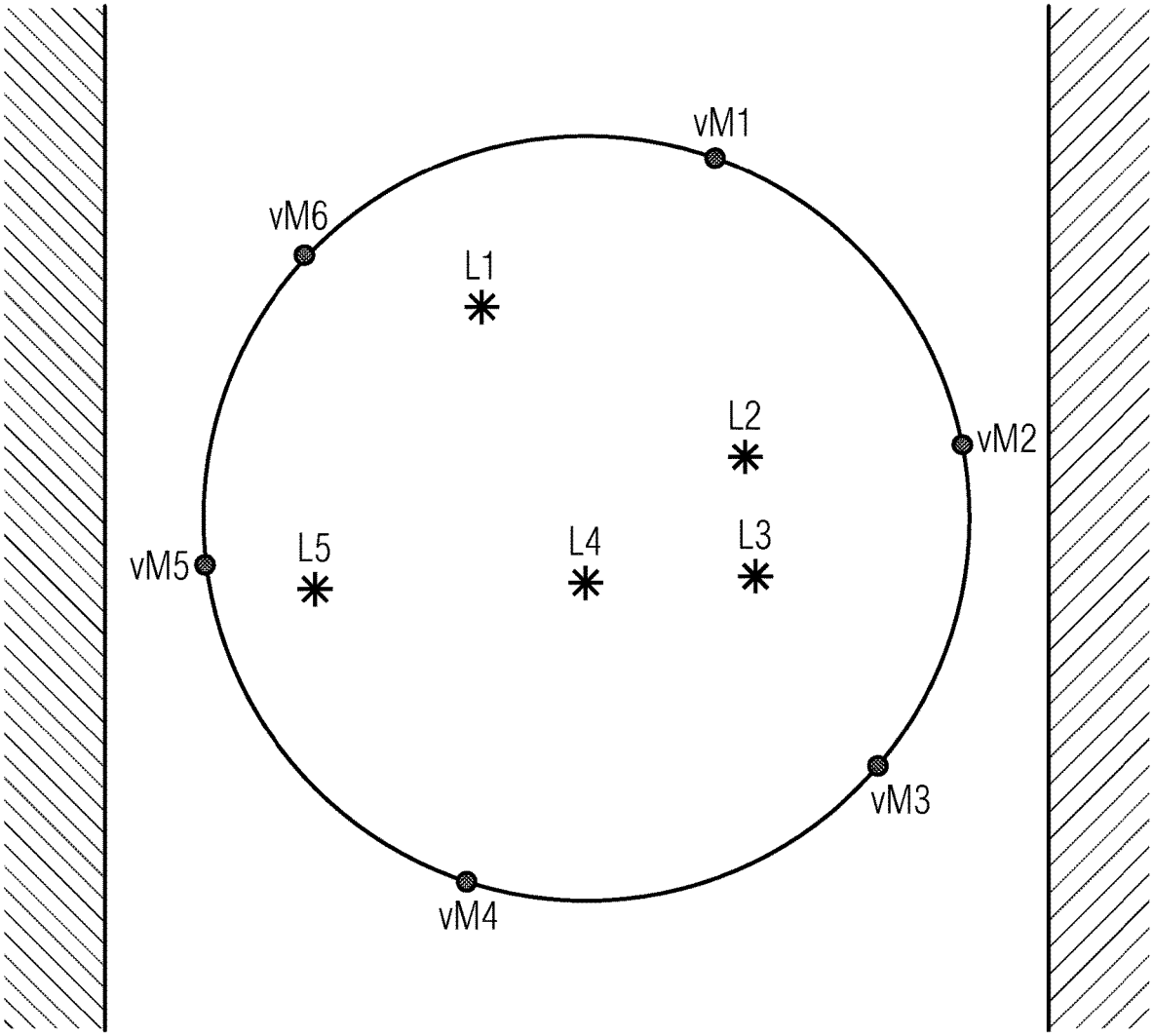

FIGS. 7*a* and 7*b* show an area for explaining what happens to the recorded audio signals (or audio signals for short) on their way to the reproduction session.

The audio signals from various sources (having unknown or even varying locations within the recording session) are recorded by three sensors M1, M2, M3. The sensors M1, M2, M3 are located at different positions and have their respective transfer functions. The transfer functions are depending on their recording characteristics and on their location within the recording area, i.e. the room in which the recording is done (here indicated by the wall on the top and on the right side; the other walls may be far away).

The recorded audio signals are encoded by providing calculated audio signals that describe here four calculated virtual audio objects cAO1, cAO2, cAO3, cAO4. For the evaluation in this embodiment, a curve describing a convex hull is calculated that is based on the locations of the sensors M1, M2, M3 and surrounds at least the relevant recording area. In an embodiment, sensors are neglected (i.e. are less relevant) that are too far from a center of the sensors. The calculated audio signals are independent of the locations of the sensors M1, M2, M3 but refer to the locations of the calculated virtual audio objects cAO1, cAO2, cAO3, cAO4. Nevertheless, this calculated audio signals are less statistical dependent on each other than the recorded audio signals. This is achieved by ensuring in the calculations that each calculated virtual audio object emits signals just in one direction and not in other directions. In a further embodiment, also the transfer functions are considered by dividing them into an early and a late reflection part. Both parts are used for generating FIR filters (see above).

The transfer of the recorded audio signals with their dependency on the locations of the sensors M1, M2, M3 to the calculated audio signals associated with locations of calculated virtual audio objects cAO1, cAO2, cAO3, cAO4 is summarized by the filter matrix $W^{(rec)}$ for the recording session. The calculated audio signals are a neutral format of the audio signals and are neutral with regard to the setting of the recording session.

In a following step, the calculated audio signals belonging to the calculated virtual audio objects cAO1, cAO2, cAO3, cAO4 are used for calculating virtual microphone signals for—here six—virtual microphones vM1, vM2, vM3, vM4, vM5, vM6. The virtual microphones vM1, vM2, vM3, vM4, vM5, vM6 are—in the shown embodiment—located at a circle. The calculation for obtaining the signals to be received by the virtual microphones is done using in one embodiment the Green's function G as a filter matrix.

In the next step, the virtual microphone signals are used for providing the reproduction signals to be reproduced by the actuators (her shown in FIG. 7*b*). For this, the actual locations of the actuators L1, L2, L3, L4, L5 are used for calculating, similar to the processing at the recording side, a convex hull describing the—or at least the relevant—actuators and normal vectors of the convex hull. Using this data, a dictionary matrix 1 is calculated that refers to the locations of the actuators and the normal vectors. The calculation is done by minimizing the cost function J depending on the dictionary matrix 1 and the transfer functions of the actuators. In one embodiment, especially the late reflection part of the transfer functions is used. The transfer functions of the actuators L1, L2, L3, L4, L5 are also depending on the surrounding of the reproduction session which is indicated here by the two walls on the left and on the right; the other walls may be at a greater distance. The resulting adapted audio signals—as they are the encoded audio signals adapted to the reproduction session—are to be reproduced by the actuators L1, L2, L3, L4, L5 and provide the same wave field as defined by the virtual microphone signals.

The system and the connected nodes (sensors, actuators) can also be described as a combination of an encoding and a decoding apparatus. Here, encoding comprises processing the recorded signals in such a way that the signals are given in a form independent of the parameters of the recording session, e.g. in a neutral format. The decoding on the other hand comprises adapting encoded signals to the parameters of the reproduction session.

Figure 8A:
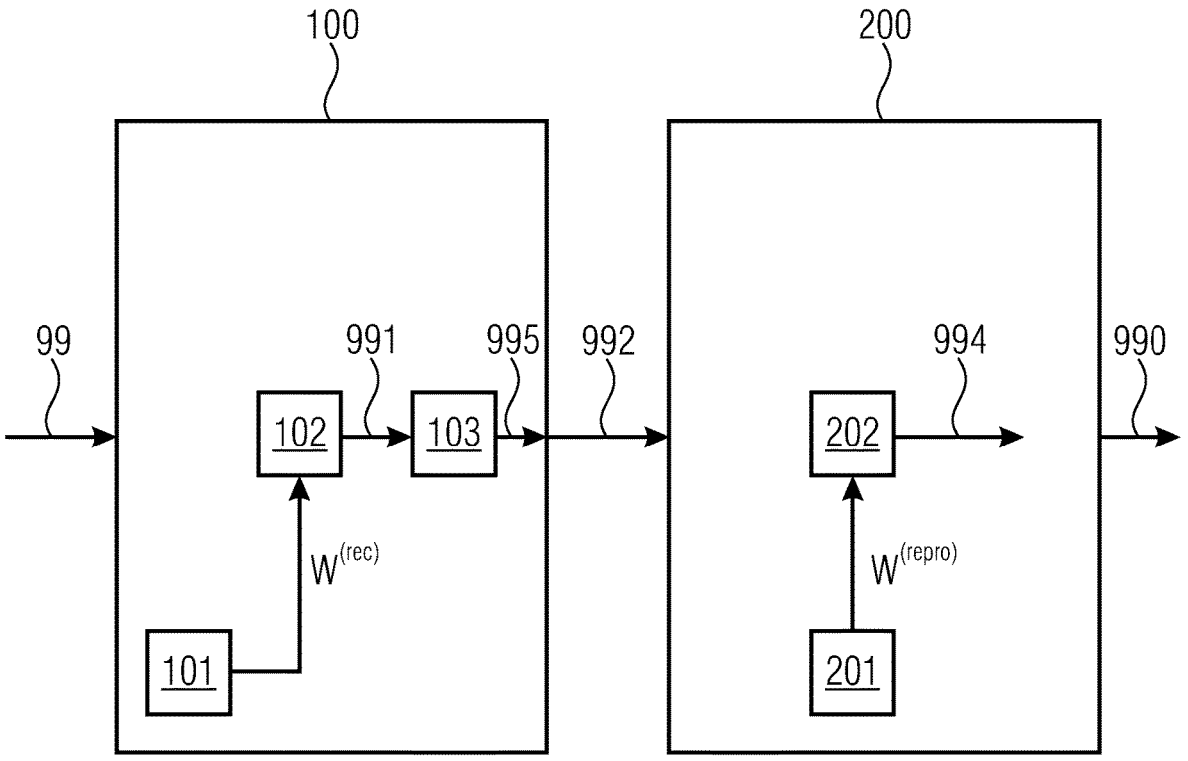
FIGS. 8*a* and 8*b* show a decoder-encoder scenario for the handling of audio signals.
Figure 8B:
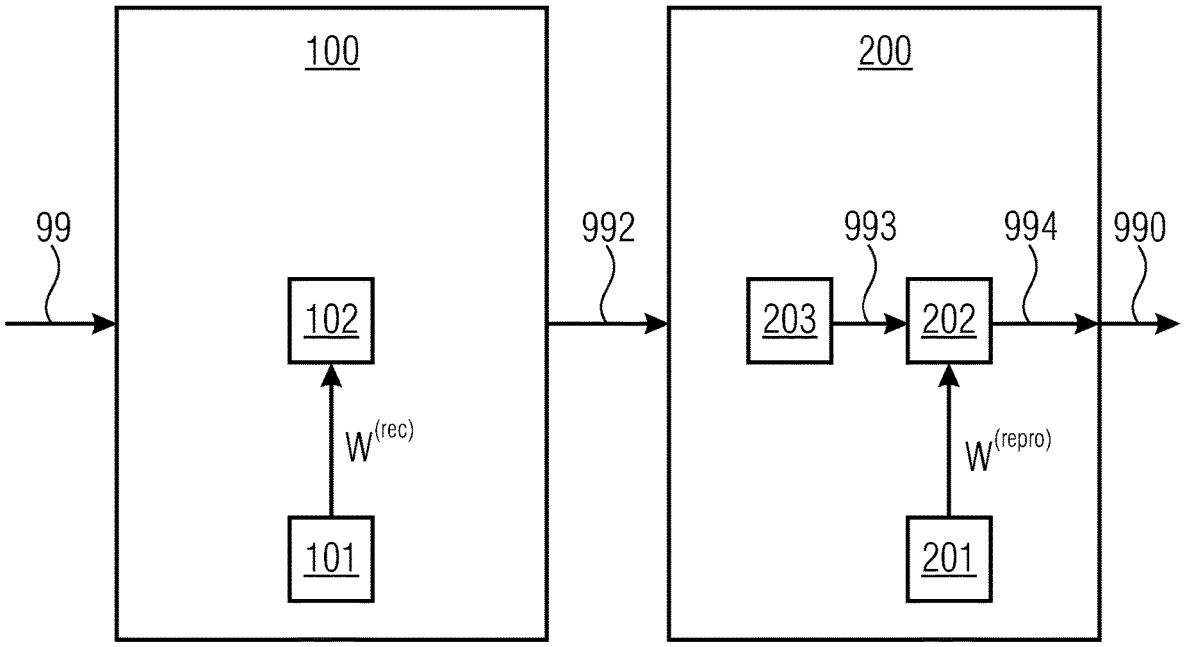

An encoder apparatus (or encoding apparatus) 100 shown in FIG. 8 *a*) encodes audio signals 99 recorded in a recording scenario and provides encoded audio signals 992. Other types of encoding or decoding of signals or audio signals are not shown.

A filter provider 101 is configured to calculate a signal filter $W^{(rec)}$ that is based on the locations of the sensors used in the recording session for recording the audio signals 99 and in this embodiment based on the transfer functions of the sensors which takes the surrounding of the recording session into account. The signal filter $W^{(rec)}$ refers to the calculated virtual audio objects which are in an embodiment mutually statistically independent as they emit audio signals in just one direction. This signal filter $W^{(rec)}$ is applied by the filter applicator 102 to the audio signals 99. The resulting calculated audio signals 991 are the signals which emitted by the calculated virtual audio objects provide the same wave field as that given by the recorded audio signals 99. Further, the filter provider 101 also provides the locations of the calculated virtual audio objects.

Hence, the audio signals 99 that are dependent on the locations of the sensors and here also on the transfer functions are transformed into calculated audio signals 991 that describe the virtual audio objects positioned at the calculated locations but that are less statistically dependent on each other and in one embodiment especially mutually independent of each other.

In a next step, a virtual microphone processor 103 provides virtual microphone signals for the virtual microphones that are located at set or pre-defined positions. This is done using a filter matrix G which is in an embodiment Green's function. Thus, the virtual microphone processor 103 calculates based on a given number of virtual microphones and their respective pre-known or set positions the virtual microphone signals that cause the wave field experienced with the calculated audio signals 991. These virtual microphone signals are used for the output of the encoded audio signals 992. The encoded audio signals 992 comprise in an embodiment also metadata about locations of the virtual microphones. In a different embodiment, this information can be omitted due to the facts that the locations of the virtual microphones are well known to the decoder 200, e.g. via a predefinition.

A decoder apparatus (or decoding apparatus) 200 receives the encoded audio signals 992. A filter provider 201 provides a signal filter $W^{(repro)}$) that is based on the locations of the actuators to be used for the reproduction of the decoded audio signals 990 and based on the locations associated with the encoded audio signals 992—here, this are the locations of the virtual microphones. The information about the location is either part of metadata comprised by the encoded audio signals 992 or is known to the decoder apparatus 200 (this especially refers to the shown case that the encoded audio signals 992 belong to virtual microphones). Based on the location information the filter provider 201 provides the signal filter $W^{(repro)}$) that helps to adapt the encoded audio signals 992 to the conditions of the reproduction session. The actual calculation is in one embodiment as outlined above.

In the embodiment of FIG. 8 *a*), the decoding apparatus 200 receives encoded audio signals 992 that belong to virtual microphones. Due to this, the filter applicator 202 applies the signal filter $W^{(repro)}$ to the encoded audio signals 992 and provides the adapted audio signals 994 adapted to the recording session. Based on the adapted audio signals 994, the decoded audio signals 990 are output and reproduced by the actuators.

The embodiment shown in FIG. 8 *b*) differs from the embodiment shown in FIG. 8 *a*) by the location of the virtual microphone processor. In the embodiment of FIG. 8 *b*), the encoding apparatus 100 provides encoded signals 992 that refer to the calculated virtual audio objects and their positions. Hence, the decoding apparatus 200 comprises a virtual microphone processor 203 that generates the virtual microphone signals 993 to which the filter applicator 202 applies the signal filter $W^{(repro)}$ in order to provide the adapted audio signals 994. In a further embodiment, no virtual microphone processor 203 is given and the filter provider 201 calculates the signal filter $W^{(repro)}$ based on the locations of the calculated virtual audio objects and the locations of the actuators.

Although some aspects have been described in the context of a system or apparatus, it is clear that these aspects also represent a description of the corresponding method, where a block or device corresponds to a method step or a feature of a method step. Analogously, aspects described in the context of a method step also represent a description of a corresponding block or item or feature of a corresponding system/apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive transmitted or encoded signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a non-transitory storage medium such as a digital storage medium, or a computer-readable medium) comprising, recorded thereon, the computer program for performing one of the methods described herein. The data carrier, the digital storage medium or the recorded medium are typically tangible and/or non-transitory.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

Brandstein, M. S., Ward, D. B., (eds.), Microphone Arrays: Signal Processing Techniques and Applications, Springer Verlag, 2001.

E. J. Candés and Y. Plan. Matrix completion with noise. Proceedings of the IEEE 98(6), 925-936.

J. Daniel. Representation de champs acoustiques, application á la transmission et á la reproduction de scénes sonores complexes dans un contexte multimédia. PhD thesis, Université Paris 6, 2000.

M. Fink, Time reversal of ultrasonic fields—Part I: Basic principles. IEEE Transactions on Ultrasocics, Ferroelectrics, and Frequency Control, 39(5):555-566, September 1992.

K. Helwani and H. Buchner, "Adaptive Filtering in Compressive Domains", Proc. IEEE IWAENC, Nice, 2014.

K. Helwani, H. Buchner, J. Benesty, and J. Chen, "Multichannel acoustic echo suppression," Proc. IEEE Int. Conf. on Acoustics, Speech, and Signal Processing (ICASSP), Vancouver, Canada, May 2013.

K. Helwani, S. Spors, and H. Buchner, "The synthesis of sound figures," Journal on Multidimensional Systems and Signal Processing (MDSSP), Springer, November 2013.

A. Hyvärinen, J. Karhunen and E. Oja, Independent Component Analysis.

J. O'Rourke, Computational Geometry in C, Cambridge University Press, 1993

S. Spors, R Rabenstein, The theory of wave field synthesis revisited 124th AES Convention, 17-20.

R. Stewart and M. Sandler, "STATISTICAL MEASURES OF EARLY REFLECTIONS OF ROOM IMPULSE RESPONSES", Proc. of the 10th Int. Conference on Digital Audio Effects (DAFx-07), Bordeaux, France, Sep. 10-15, 2007.

The invention claimed is:

1. A system for handling digital content, wherein the system comprises an input interface, a calculator, and an output interface, and wherein the system is a platform for ad hoc multichannel audio capturing and rendering, wherein the input interface is configured to wirelessly receive the digital content, wherein the input interface comprises a plurality of Ni input channels, wherein a group of input channels is configured to receive the digital content from a group of sensors belonging to a recording session, wherein the calculator is configured to provide an output digital content by adapting the digital content to a reproduction session in which the output digital content is to be reproduced, wherein the output interface is configured to output the output digital content, wherein the output interface comprises a plurality of No output channels, wherein a group of output channels is configured to wirelessly output the output digital content to a group of actuators belonging to the reproduction session, wherein the input interface, the calculator, and the output interface are connected with each other via a network, wherein the number Ni is based on a user interaction, and wherein the number No is based on a user interaction, wherein the system is configured to allow associating the digital content with the recording session or the output digital content with the reproduction session, wherein the recording session is associated with the group of sensors and wherein the reproduction session is associated with the group of actuators, wherein the system is configured to handle the digital content belonging to the recording session, and wherein the system is configured to handle the digital content belonging to the reproduction session, wherein the system is configured to initialize a time synchronization routine for the group of sensors associated with the recording session, so that the sensors of the group of sensors are time synchronized, wherein the system is configured to initialize a time synchronization routine for the group of actuators associated with the reproduction session, so that the actuators of the group of actuators are time synchronized, wherein the system is configured to initialize a localization routine for the group of sensors providing information about locations of the sensors of the group of sensors, and wherein the system is configured to initialize a localization routine for the group of actuators providing information about locations of the actuators of the group of actuators.

2. The system of claim 1, wherein a central unit comprising the input interface, the calculator, and the output interface is configured to use the input channels for the time synchronization of the group of sensors by providing a common clock signal for the group of sensors, and wherein the central unit is configured to use the input channels for triggering the group of sensors to submit information about their locations to the central unit.

3. The system of claim 1, wherein the calculator is configured to provide a modified content by adapting the digital content to a reproduction session neutral format based on the information about the locations of the group of sensors, and wherein the calculator is configured to adapt the modified content being in the reproduction session neutral digital content to the reproduction session based on the information about the locations of the group of actuators.

4. The system of claim 1 wherein the locations of the sensors of the group of sensors are time-variant, and wherein the system is configured to run an algorithm for automatic synchronization localization the recording session.

5. The system of claim 1, wherein the platform is configured to combine different recording sessions and different kinds of the digital content with different reproduction sessions, and wherein platform is configured to personalize the recording session and the reproduction session concerning the numbers of the groups of sensors and actuators and the positions of the groups of sensors and the groups of actuators, respectively.

6. The system of claim 1, wherein the calculator is configured to provide a temporally coded content by performing a temporal coding on the digital content to obtain a temporally compressed format, wherein the temporal coding comprises recording a time stamp track in addition to an actual audio signal for sensor of the group of sensors, wherein the time stamp is acquired from a globally provided clock signal or from a session local network clock.

7. The system of claim 1, wherein the system comprises a user interface for allowing a user an access to the system, wherein the user interface is web-based, and wherein the user interface is configured to allow the user to initiate at least one of the following sessions:

a registering session comprising registering the user or changing a user registration or de-registering the user, a login/logout session comprising a login of the user or a logout of the user, a sharing session sharing a session, the recording session comprising recording the digital content or uploading the digital content, the reproduction session comprising outputting the output digital content or reproducing the output digital content, and a duplex session comprising a combination of the recording session and the reproduction session.

8. The system of claim 1, wherein the group of sensors in the recording session comprises a number of smartphones, and wherein the group of actuators in the reproduction setting comprises a number of smartphones, and wherein the digital content is transmitted via mobile phone connections.

9. The system of claim 1, wherein the system is configured to initialize a calibration routine for the group of sensors associated with the recording session for providing calibration data for the group of sensors, and to initialize a calibration routine for the group of actuators associated with the reproduction session for providing calibration data for the group of actuators.

10. The system of claim 8, wherein the calculator is configured to provide the output digital content based on the digital content and based on transfer functions associated with the group of sensors belonging to the recording session by decomposing a wave field of the specified recording session into mutually statistically independent components, where the mutually statistically independent components are projections onto basis functions, where the basis functions are based on normal vectors and the transfer functions, and where the normal vectors are based on a curve calculated based on locations associated with the group of sensors belonging to the recording session, or wherein the calculator is configured to provide the output digital content based on the digital content and based on transfer functions associated with the group of actuators belonging to the reproduction session by decomposing a wave field of the recording session into mutually statistically independent components, where the mutually statistically independent components are projections onto basis functions, where the basis functions are based on normal vectors and the transfer functions, and where the normal vectors are based on a curve calculated based on locations associated with the group of actuators belonging to the reproduction session.

11. The system of claim 8, wherein the calculator is configured to divide the transfer functions in a time domain into early reflection parts and late reflection parts.

12. The system of claim 1, wherein the calculator is configured to provide a signal description for the digital content based on locations associated with the group of actuators of the reproduction session, where the signal description is given by decomposing the digital content into spatially independent signals that sum up to an omnidirectional sensor, and where the spatially independent signals comprise corresponding looking directions towards the actuators or of the group of actuators and spatial nulls into directions different from the looking directions.

13. The system of claim 1, wherein the system is configured to handle the digital content in full duplex, wherein a duplex session comprises a combination of the recording session and the reproduction session, and wherein the calculator is configured to perform a multichannel acoustic echo control in order to reduce echoes resulting from couplings between the group of sensors associated with the recording session and the group of actuators associated with the reproduction session.

14. A method for handling digital content, comprising:

receiving the digital content by a input interface, wherein the input interface comprises a plurality of Ni input channels, wherein the input channels are configured to receive the digital content from a group of sensors belonging to a recording session; wherein the method comprises operating a platform for ad hoc multichannel audio capturing and rendering, providing an output digital content by adapting the digital content to a reproduction session in which the output digital content is to be reproduced, and outputting the output digital content by an output interface, wherein the output interface comprises a plurality of Ni output channels, wherein the output channels are configured to output the output digital content to a group of actuators belonging to the reproduction session, wherein the digital content and/or the output digital content is transferred via a wireless network, and wherein the number Ni is based on a user interaction, and wherein the number No is based on a user interaction, wherein the method allows associating the digital content with the recording session or the output digital content with the reproduction session, wherein the recording session is associated with the group of sensors and wherein the reproduction session is associated with the group of actuators, wherein the method handles the digital content belonging to the recording session, and wherein the method handles the digital content belonging to the reproduction session, wherein method initializes a time synchronization routine for the group of sensors associated with the recording session, so that the sensors of the group of sensors are time synchronized, wherein the method initializes a time synchronization routine for the group of actuators associated with the reproduction session, so that the actuators of the group of actuators are time synchronized, wherein the method initializes a localization routine for the group of sensors providing information about locations of the sensors of the group of sensors, and wherein the method initializes a localization routine for the group of actuators providing information about locations of the actuators of the group of actuators.

15. A non-transitory digital storage medium having a computer program stored thereon to perform, when said computer program is run by a computer, the method for handling digital content, the method comprising:

receiving the digital content by a input interface, wherein the input interface comprises a plurality of Ni input channels, wherein the input channels are configured to receive the digital content from a group of sensors belonging to a recording session, wherein the method comprises operating a platform for ad hoc multichannel audio capturing and rendering, providing an output digital content by adapting the digital content to a reproduction session in which the output digital content is to be reproduced, and outputting the output digital content by an output interface, wherein the output interface comprises a plurality of Ni output channels, wherein the output channels are configured to output the output digital content to a group of actuators belonging to the reproduction session, wherein the digital content and the output digital content is transferred via a wireless network, and wherein the number Ni is based on a user interaction, and wherein the number No is based on a user interaction, wherein the method allows associating the digital content with the recording session or the output digital content with the reproduction session, wherein the recording session is associated with the group of sensors and wherein the reproduction session is associated with the group of actuators, wherein the method handles the digital content belonging to the recording session, and wherein the method handles the digital content belonging to the reproduction session, wherein method initializes a time synchronization routine for the group of sensors associated with the recording session, so that the sensors of the group of sensors are time synchronized, wherein the method initializes a time synchronization routine for the group of actuators associated with the reproduction session, so that the actuators of the group of actuators are time synchronized, wherein the method initializes a localization routine for the group of sensors providing information about locations of the sensors of the group of sensors, and wherein the method initializes a localization routine for the group of actuators providing information about locations of the actuators of the group of actuators.

16. The system of claim 12, wherein the actuators of the group of actuators are spatially surrounded by the sensors, and wherein the spatial nulls correspond to sectors of quiet zones or are based on at least one focused virtual sink with a directivity pattern achieved by a superposition of focused multipole sources according to a wave field synthesis or according to a time reversal cavity.

17. The system of claim 1, wherein the positions associated with the sensors of the group of sensors of the recording session and the positions associated with the actuators of the group of actuators of the reproduction session, respectively, coincide within a given tolerance level, and wherein the calculator is configured to provide the output digital content so that the actuators reproduce the digital content recorded by the sensors with coinciding positions, or wherein the positions associated with the group of sensors of the recording session and associated with the group of actuators of the reproduction session, respectively, coincide up to a spatial shift, and wherein the calculator is configured to provide the output digital content based on a compensation of the spatial shift.

18. The system of claim 1, wherein the calculator is configured to provide the output digital content by performing an inverse modeling for the digital content by calculating a system inversing a room acoustic of a reproduction room of a recording session, or wherein the calculator is configured to provide the output digital content by adapting the digital content to a virtual reproduction array and by extrapolating the adapted digital content to positions associated with the group of actuators of the reproduction session, or wherein the calculator is configured to provide the output digital content based on the digital content by placing virtual sources either randomly or according to data associated with the number No of output channels.

19. The system of claim 1, wherein the time synchronization routine for the recording session is performed such that each sensor of the group of sensors of the recording session acquires a common clock signal, and wherein the time synchronization routine for the reproduction session is performed such that each actuator of the group of actuators of the reproduction session acquires a common clock signal for the actuators.

* * * * *